US012807281B1

(12) United States Patent
Hopkins

(10) Patent No.: US 12,807,281 B1
(45) Date of Patent: Nov. 24, 2026

(54) WATERCRAFT STABILITY RAIL

(71) Applicant: Ideal, LLC, Asheville, NC (US)

(72) Inventor: William Lucas Hopkins, Asheville, NC (US)

(73) Assignee: Ideal, LLC, Asheville, NC (US)

( * ) Notice: Subject to any disclaimer, the term of this patent is extended or adjusted under 35 U.S.C. 154(b) by 0 days.

(21) Appl. No.: 19/443,777

(22) Filed: Jan. 8, 2026

Related U.S. Application Data

(63) Continuation of application No. 30/036,066, filed on Dec. 4, 2025.

(51) Int. Cl.
*B63B 32/51* (2020.01)
*B63B 32/57* (2020.01)

(52) U.S. Cl.
CPC ..... *B63B 32/51* (2020.02); *B63B 32/57* (2020.02)

(58) Field of Classification Search
CPC ..... B63B 32/00; B63B 32/51; B63B 32/57; B63B 35/00; B63B 35/79
USPC ..... 441/66, 74, 79
See application file for complete search history.

(56) References Cited

U.S. PATENT DOCUMENTS 8,333,630 B1 12/2012 Bedford

*Primary Examiner* — Lars A Olson
(74) *Attorney, Agent, or Firm* — Patricia C. Brzostowicz; CR MILES P.C.

(57) ABSTRACT

A stability device for stabilizing a watercraft is disclosed. The stability device comprises at least one stability rail or at least two stability rails comprising a mid-section and two flanking end sections. A first side of each section can be coupled to the watercraft. The stability rail may have a Shore A Hardness of at least fifty and not more than ninety-five, being flexible enough to be fitted to an inflatable stand up paddleboard or kayak. Methods of making the stability rail of the present disclosure are provided herein. Methods of forming more stable watercraft using a stability rail of the present disclosure are provided herein.

19 Claims, 17 Drawing Sheets

WATERCRAFT STABILITY RAIL

I. FIELD

The present disclosure relates to a device for stabilizing watercraft, especially inflatable watercraft including inflatable stand-up paddleboards, kayaks, and canoes.

II. BACKGROUND

Paddle watersport participation continues to grow in popularity, increasing at a rate of twenty-six percent in the past three years according to the American Canoe Association. Unfortunately, paddle watersport fatalities account for thirty percent of watercraft fatalities with stand-up paddleboard (SUP) fatalities rising one-hundred sixty-four percent from 2023 to 2024. These fatalities result from drowning of sport participants following falling from or tipping out of or off the watercraft. Stability of watercraft can be a major factor in preventing tipping of watercraft, especially inflatable watercraft such as SUPs and kayaks. Stability can be influenced by width, thickness, inflation pressure, and fin area. Fin area can also influence tracking or the ability to keep the board going or tracking in a straight line, with increased fin area increasing tracking helping the board go straighter, requiring less switching of paddles from side to side to maneuver a watercraft. Especially with increasing interest due to ease of use of inflatable watercraft like SUPs there is a need for better solutions to increase stability, tracking, maneuverability, and handleability of these watercraft.

III. SUMMARY

The present disclosure comprises a device for increasing stability, tracking, maneuverability, and handleability of a watercraft. The present disclosure further comprises a watercraft with improved stability, tracking, and handleability. The present disclosure further comprises a method of making a watercraft stabilizing device. The present disclosure further comprises a method of making a watercraft with improved stability, tracking, and handleability.

As such, the present disclosure comprises a watercraft stability device, comprising: at least one rail comprising a mid-section and two end sections, wherein the two end sections flank the mid-section; wherein the mid-section comprises three sides, a first mid-section side designed to engage a convex edge of the watercraft, a second mid-section side, and a third substantially flat mid-section side; wherein the second mid-section side and the third substantially flat mid-section side meet forming an angled relation with each other; and wherein the at least one rail is flexible.

In other embodiments, the present disclosure comprises a stability device for a watercraft comprising: at least one rail comprising a mid-section and two end sections, wherein the two end sections flank the mid-section; wherein the mid-section comprises three sides, a first mid-section side designed to engage a convex edge of the watercraft, a second mid-section side, and a third substantially flat mid-section side, wherein the second mid-section side and the third substantially flat mid-section side meet in angled relation with each other; wherein the two end sections each comprise two sides, a first end-section side, and a second end-section side, wherein the two sides taper in width to terminal ends of the at least one rail; wherein the first mid-section side and the first end-section side are coupled to form an inside portion of the at least one rail that is designed to engage the convex edge of the watercraft; wherein the second mid-section side and third substantially flat mid-section side are coupled to the second end-section side to form an outside portion of the at least one rail; and wherein the at least one rail is flexible. In other embodiments at least one rail comprising a mid-section and two end sections, wherein the two end sections flank the mid-section; wherein the mid-section comprises three sides, a first concave mid-section side, a second mid-section side, and a third substantially flat mid-section side, wherein the second mid-section side and the third substantially flat mid-section side meet to form a corner having a substantially ninety degree angle; wherein the two end sections each comprise two sides, a first concave end-section side, and a second end-section side, wherein the two sides taper in width to a terminal end of the at least one rail; wherein the first concave mid-section side and the first concave end-section side are coupled to form an inside portion of the at least one rail that is designed to engage a convex edge of the watercraft; wherein the second mid-section side and third substantially flat mid-section side are coupled to the second end-section side to form an outside portion of the at least one rail; and wherein the at least one rail is flexible The present disclosure further comprises a watercraft comprising: at least two rails each comprising a mid-section and two end sections, wherein the two end sections flank the mid-section; wherein the mid-section comprises three sides, a first mid-section side, a second mid-section side, and a third substantially flat mid-section side; wherein the second mid-section side and the third substantially flat mid-section side meet in angled relation to each other; wherein each of the at least two rails are flexible; and wherein each of the at least two rails are disposed longitudinally in a mid-section of the watercraft on outer edges of the side of the watercraft designed to contact a body of water. In other embodiments, the watercraft comprises: at least two rails each comprising a mid-section and two end sections, wherein the two end sections flank the mid-section; wherein the mid-section comprises three sides, a first concave mid-section side, a second concave mid-section side, and a third substantially flat mid-section side, wherein the second concave mid-section side and the third substantially flat mid-section side meet to form a rounded corner at substantially a ninety degree angle; wherein the two end sections each comprise two sides, a first concave end-section side, and a second convex end-section side, wherein the two sides taper in width to a terminal rounded end of the at least two rails; wherein the first concave mid-section side and the first concave end-section side are coupled to form an inside portion of the at least two rails that are designed to engage a convex edge of the watercraft; wherein the second concave mid-section side and third substantially flat mid-section side are coupled to the second convex end-section side to form an outside portion of the at least two rails; and wherein the at least two rails are flexible and disposed on a side of the watercraft designed to contact a body of water on outer edges in a mid-section of longer sides of the watercraft.

The present disclosure further comprises a method of forming a watercraft stabilizing device, the method comprising the steps of: forming at least one rail comprising a mid-section and two end-sections, wherein the two end-sections flank the mid-section, wherein the at least one rail: comprises a mid-section and two end-sections, wherein the two end-sections flank the mid-section; wherein the mid-section comprises three sides, a first mid-section side designed to engage a convex edge of the watercraft, a second mid-section side, and a third substantially flat mid-section side; wherein the second mid-section side and the third substantially flat mid-section side meet forming an angled relation with each other; and wherein the at least one rail is flexible. In another embodiment, the disclosure comprises a method of forming a watercraft stabilizing device, the method comprising the steps of: forming at two rails, each rail comprising a mid-section and two end sections, wherein the two end sections flank the mid-section; wherein the mid-section comprises three sides, a first concave mid-section side, a second concave mid-section side, and a third substantially flat mid-section side, wherein the second concave mid-section side and the third substantially flat mid-section side meet to form a corner at substantially a ninety degree angle; wherein the two end-sections each comprise two sides, a first concave end-section side, and a second convex end-section side, wherein the two sides taper in width to a terminal end of the at least one rail; wherein the first concave mid-section side and the first concave end-section side are coupled to form an inside portion of the at least one rail that is designed to engage a convex edge of the watercraft; wherein the second concave mid-section side and third substantially flat mid-section side are coupled to the second convex end-section side to form an outside portion of the at least one rail; and wherein the at least one rail is flexible; and adhering the at least two rails to a side of the watercraft designed to contact a body of water on outer edges in a mid-section of longer sides of the watercraft.

The present disclosure comprises a method of stabilizing a watercraft, the method comprising the steps of: forming at least two rails comprising a mid-section and two end sections, wherein the two end sections flank the mid-section; wherein the mid-section comprises three sides, a first concave mid-section side, a second concave mid-section side, and a third substantially flat mid-section side, wherein the second concave mid-section side and the third substantially flat mid-section side meet to form a rounded corner at substantially a ninety degree angle; wherein the two end sections each comprise two sides, a first concave end-section side, and a second convex end-section side, wherein the two sides taper in width to a terminal rounded end of the at least one rail; wherein the first concave mid-section side and the first concave end-section side are coupled to form an inside portion of the at least one rail that is designed to engage a convex edge of the watercraft; wherein the second concave mid-section side and third substantially flat mid-section side are coupled to the second convex end-section side to form an outside portion of the at least two rails; wherein the at least two rails are flexible; and adhering the at least two rails to a side of the watercraft designed to contact a body of water on outer edges in a mid-section of longer sides of the watercraft.

Naturally, further objects of the disclosure are disclosed throughout other areas of the specification, drawings, and claims.

IV. BRIEF DESCRIPTION OF THE DRAWINGS

V. DETAILED DESCRIPTION

Figure 1:
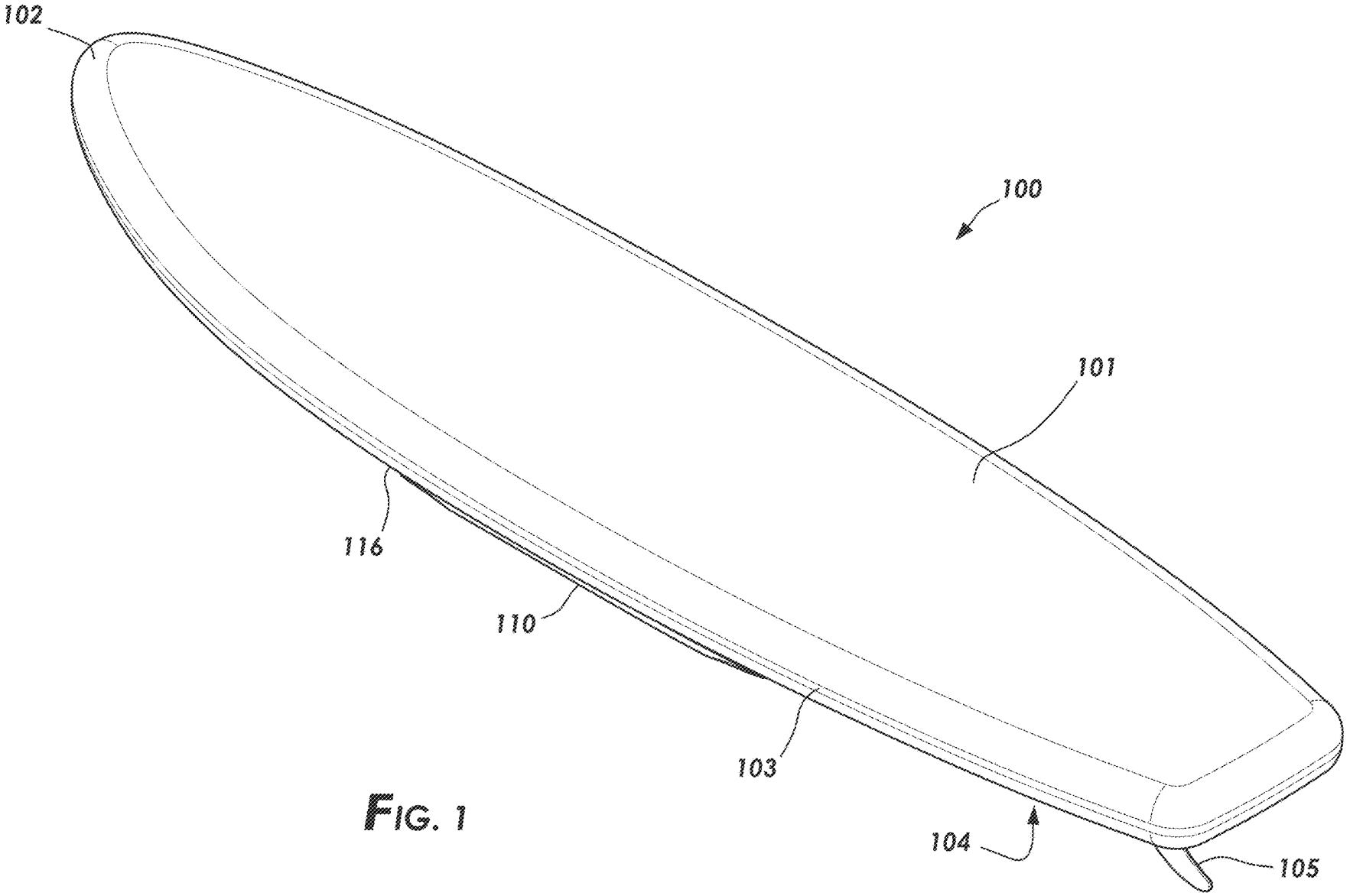
FIG. 1 is a top perspective view of a paddleboard watercraft with attached stability device of the present disclosure.
Figure 2:
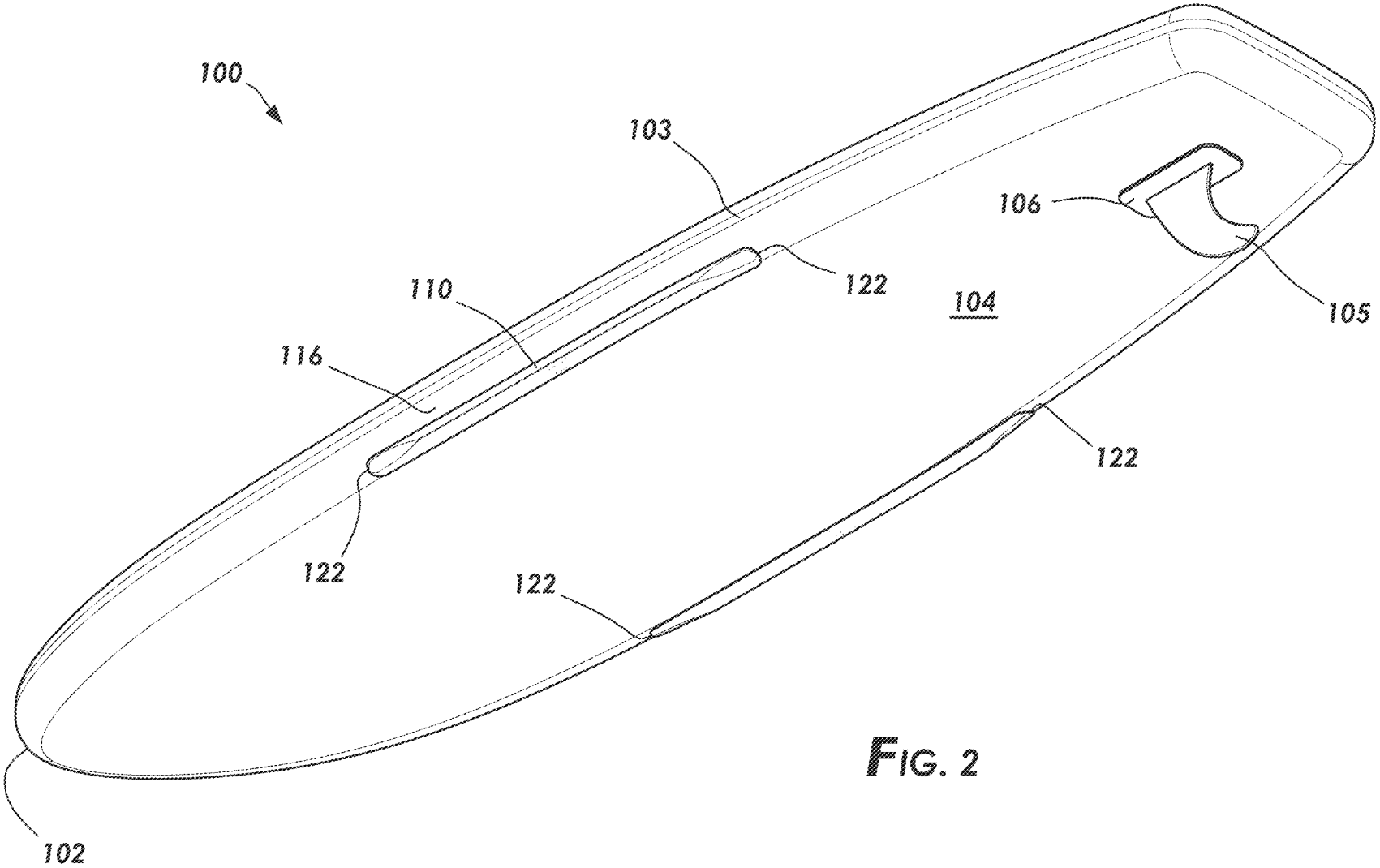
FIG. 2 is a bottom perspective view of a paddleboard watercraft with attached stability device of the present disclosure.
Figure 3:
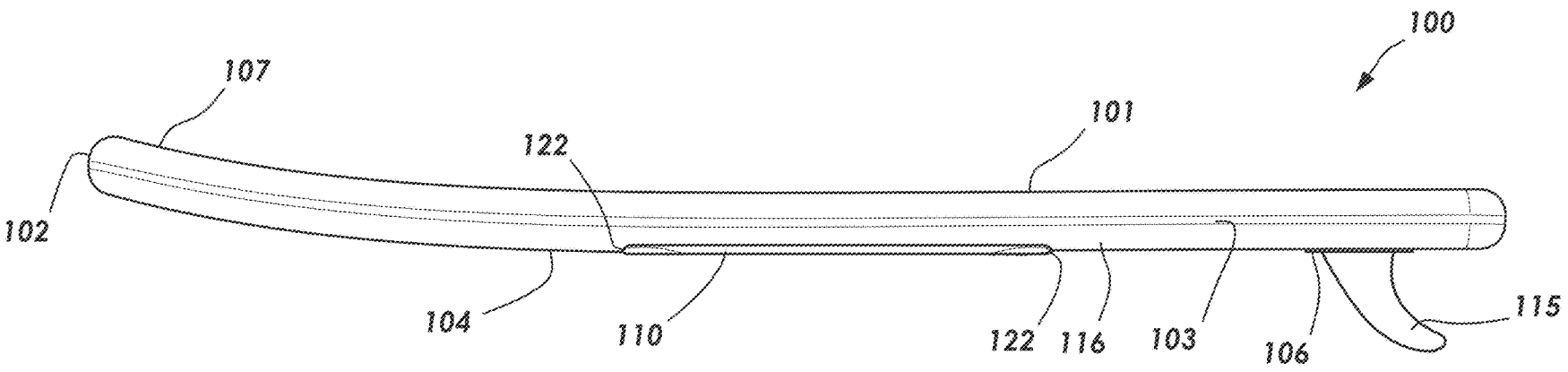
FIG. 3 is a left-side elevation view of a paddleboard watercraft with attached stability device of the present disclosure.
Figure 4:
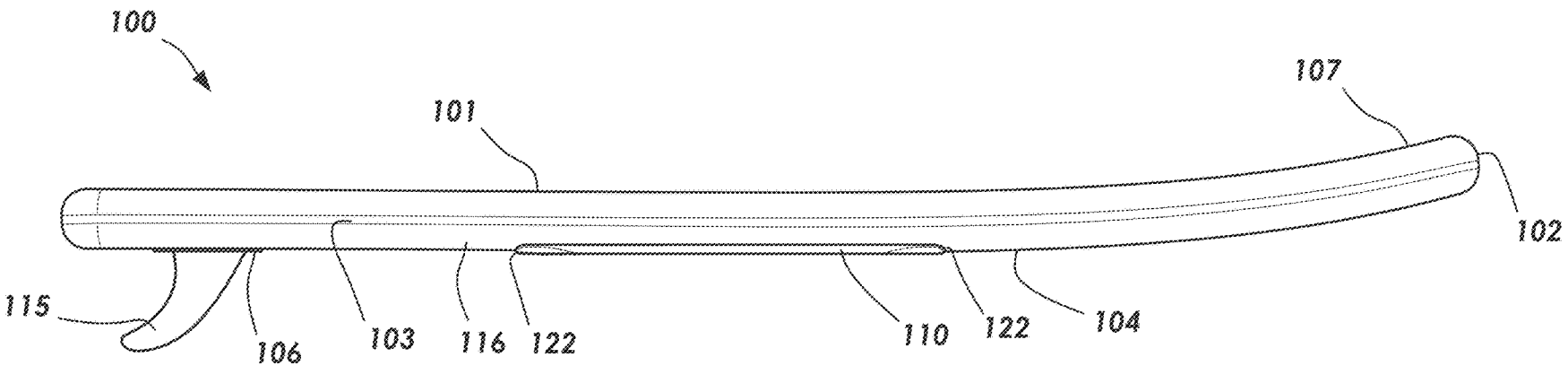
FIG. 4 is a right-side elevation view of a paddleboard watercraft with attached stability device of the present disclosure.
Figure 5:
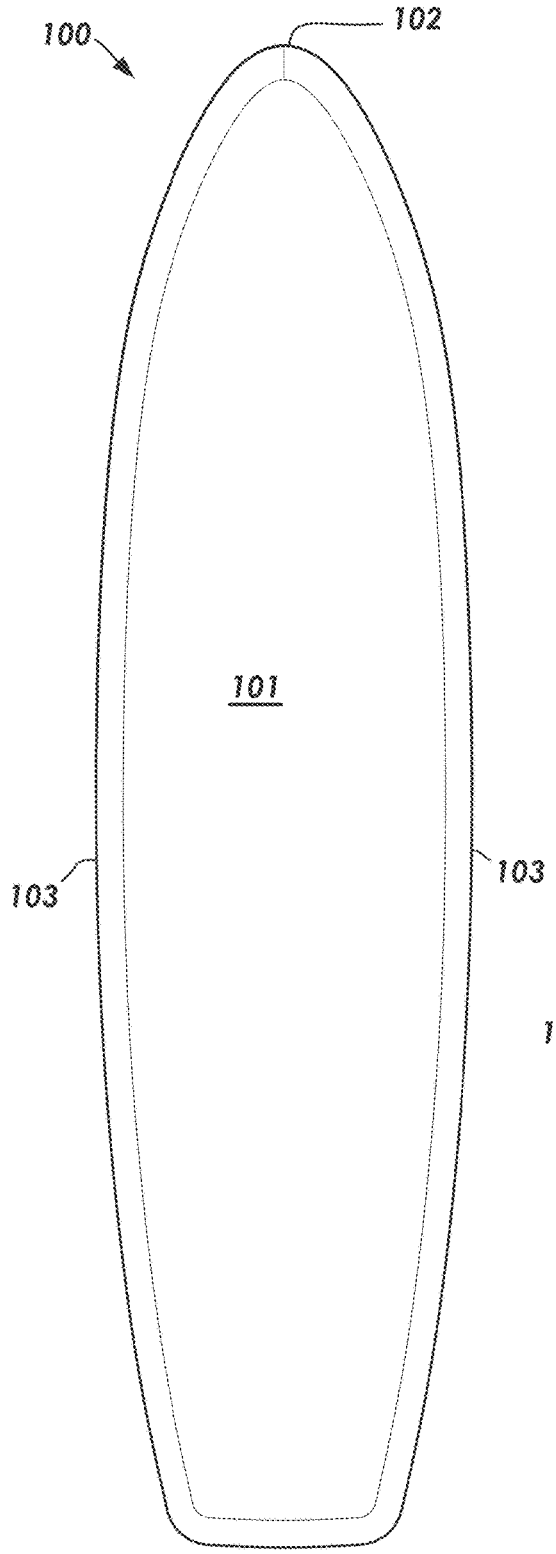
FIG. 5 is a top plan view of a paddleboard watercraft with attached stability device of the present disclosure.
Figure 6:
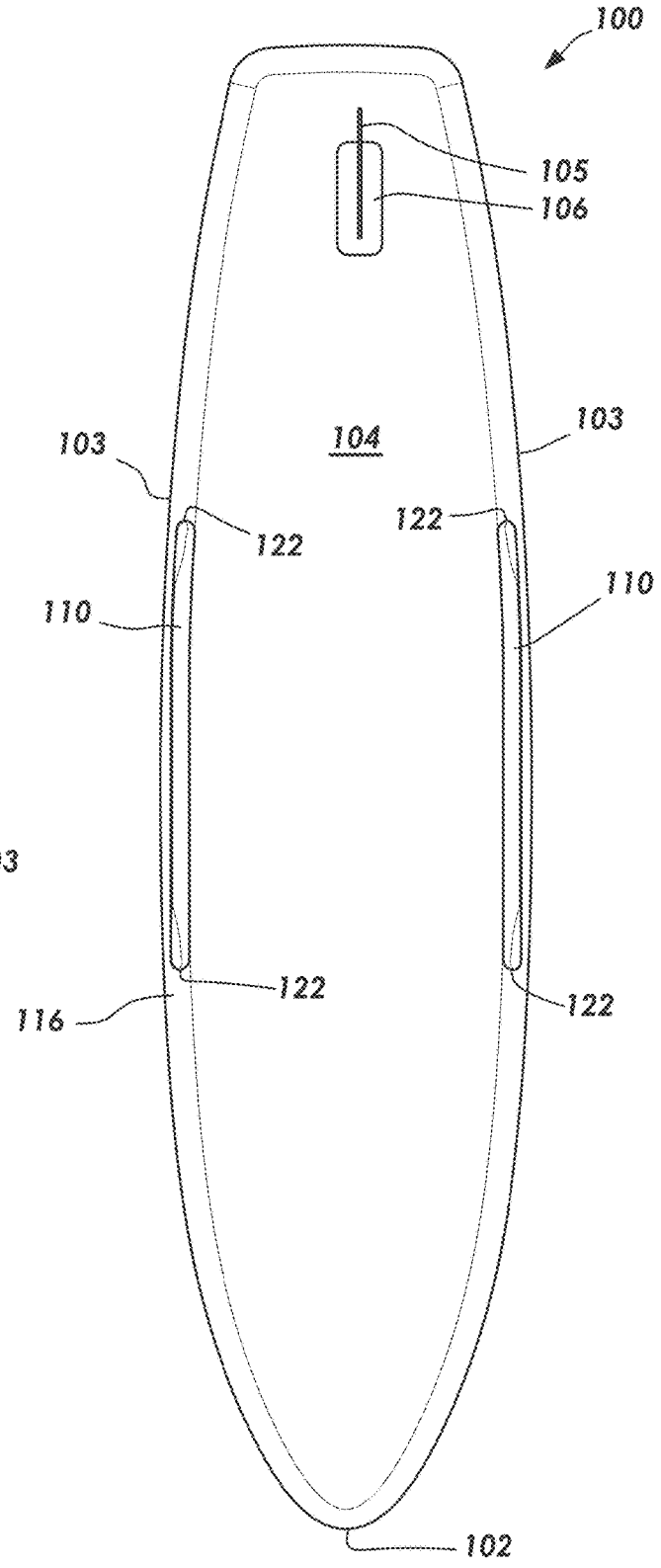
FIG. 6 is a bottom plan view of a paddleboard watercraft with attached stability device of the present disclosure.

The present disclosure, encompassed by the definitions, descriptions, claims, and FIGS. 1-29 presented herewith comprises a device for increasing stability, tracking, maneuverability, and handleability of a watercraft. The present disclosure further comprises a watercraft with improved stability, tracking, maneuverability, and handleability. The present disclosure further comprises a method of making a watercraft stabilizing device. The present disclosure further comprises a method of making a watercraft with improved stability, tracking, maneuverability, and handleability.

Inasmuch, the present disclosure, in one embodiment, comprises a stability device for a watercraft, the stability device comprising: at least one rail comprising a mid-section and two end sections, wherein the two end sections flank the mid-section; wherein the mid-section comprises three sides, a first mid-section side designed to engage a convex edge of the watercraft, a second mid-section side, and a third substantially flat mid-section side; wherein the second mid-section side and the third substantially flat mid-section side meet forming an angled relation with each other; and wherein the at least one rail is flexible. In another embodiment, the disclosure comprises a stability device for a watercraft, wherein the stability draft comprises: at least one rail comprising a mid-section and two end sections, wherein the two end sections flank the mid-section; wherein the mid-section comprises three sides, a first concave mid-section side, a second mid-section side, and a third substantially flat mid-section side, wherein the second mid-section side and the third substantially flat mid-section side meet to form a corner having a substantially ninety degree angle; wherein the two end sections each comprise two sides, a first concave end-section side, and a second end-section side, wherein the two sides taper in width to a terminal end of the at least one rail; wherein the first concave mid-section side and the first concave end-section side are coupled to form an inside portion of the at least one rail that is designed to engage a convex edge of the watercraft; wherein the second mid-section side and third substantially flat mid-section side are coupled to the second end-section side to form an outside portion of the at least one rail; and wherein the at least one rail is flexible.

The present disclosure further comprises a watercraft comprising: at least two rails each comprising a mid-section and two end sections, wherein the two end sections flank the mid-section; wherein the mid-section comprises three sides, a first mid-section side, a second mid-section side, and a third substantially flat mid-section side; wherein the second mid-section side and the third substantially flat mid-section side meet in angled relation to each other; wherein each of the at least two rails are flexible; and wherein each of the at least two rails are disposed longitudinally in a mid-section of the watercraft on outer edges of the side of the watercraft designed to contact a body of water.

The present disclosure further comprises a method of forming a watercraft stabilizing device, the method comprising the steps of: forming at least one rail comprising a mid-section and two end sections, wherein the two end sections flank the mid-section, wherein the at least one rail: comprises a mid-section and two end sections, wherein the two end sections flank the mid-section; wherein the mid-section comprises three sides, a first mid-section side designed to engage a convex edge of the watercraft, a second mid-section side, and a third substantially flat mid-section side; wherein the second mid-section side and the third substantially flat mid-section side meet forming an angled relation with each other; and wherein the at least one rail is flexible.

The present disclosure further comprises a method of forming a watercraft stabilizing device, the method comprising: forming at two rails, each rail comprising a mid-section and two end sections, wherein the two end sections flank the mid-section; wherein the mid-section comprises three sides, a first concave mid-section side, a second concave mid-section side, and a third substantially flat mid-section side, wherein the second concave mid-section side and the third substantially flat mid-section side meet to form a corner at substantially a ninety degree angle; wherein the two end sections each comprise two sides, a first concave end-section side, and a second convex end-section side, wherein the two sides taper in width to a terminal end of the at least one rail; wherein the first concave mid-section side and the first concave end-section side are coupled to form an inside portion of the at least one rail that is designed to engage a convex edge of the watercraft; wherein the second concave mid-section side and third substantially flat mid-section side are coupled to the second convex end-section side to form an outside portion of the at least one rail; and wherein the at least one rail is flexible; and adhering the at least two rails to a side of the watercraft designed to contact a body of water on outer edges in a mid-section of longer sides of the watercraft.

Definitions

As used herein, the term "watercraft" means a vessel that can travel on water, and without sacrificing the breadth the foregoing includes inflatable and non-inflatable partially-open or fully-open hull vessels, examples including but not limited to dories, pontoon boats, john boats, rafts, surf boards, kayaks, canoes, paddleboards, inflatable dinghies, inflatable catamarans, inflatable canoes, inflatable kayaks, inflatable rafts, and inflatable paddleboards, being in examples stand up paddleboards or SUPs.

As used herein, "hull" refers to the body of a watercraft.

As used herein, "bow" refers to the front of the watercraft.

As used herein, "stem" refers to the rear of the watercraft.

As used herein, "port" or "port side" refers to the left side of the watercraft.

As used herein, "starboard" or "starboard side" refers to the right side of the watercraft.

As used herein, "rudder" refers to a primary control surface, being a blade-like appendage that pivots horizontally, usually positioned at the stern of a watercraft used to steer the watercraft through water.

As used herein, "skeg" refers to a fin at the stern that counteracts weathercocking, or the tendency to turn into the wind in windy conditions, improving tracking. A skeg can be a retractable skeg or fin.

As used herein, "nose" refers to the front or front tip of a watercraft.

As used herein, "deck" refers to the top side of a watercraft that is out of the water.

As used herein, a "deck pad" refers to a section of a watercraft on the deck of a watercraft that may have additional or differing surface features from the deck.

As used herein, "fin" refers to an appendage attached to generally a paddleboard or surfboard but other watercraft as well, such as kayaks, having the general shape of a fish fin and generally positioned on the bottom or hull of the watercraft that sits in the water, being an article crucial for stability, tracking, or moving in a straight line, control, enhancing maneuverability, allowing for easier steering, and spin prevention. Generally, from one to five fins can be utilized on watercraft in various configurations.

As used herein, "length" refers to the measurement of distance from end to end, being the longest dimension of the object, in some examples from bow to stern, or nose to stern of the watercraft.

As used herein, "width" refers to measurement of distance from side to side, being the shortest dimension of the object, in some examples from port to starboard of the watercraft.

As used herein, "height" or "thickness" refers to measurement of distance up and down along a side or vertical measurement of the object, in some examples from top of deck to bottom of hull.

As used herein, an "angled relation" refers to a relationship between two parts, in some examples sides of an object, wherein the two parts have a connected relationship to each other meeting at an angle having a geometric measurement of at least one degree or more.

As used herein, a "fin area" is the vertical surface area of a fin or fins placed on a watercraft that extend into a body of water when the watercraft is in use. The vertical surface of a device of the present disclosure is also a fin area such that a "fin area" or "total fin area" would include any vertical surface area of a fin or fins plus the vertical surface area of a stability device of the present disclosure on the watercraft.

Description

The following description with reference to FIGS. 1-29, comprises a stability device for watercraft (100, 200), wherein the stability device may comprise at least one stability rail (110), or at least two stability rails (110). The description further comprises methods of making the stability rail (110) of the present disclosure. The description further comprises method of making a watercraft more stable via attachment of at least one stability rail (110) to a watercraft (100, 200).

In general, watercraft (100, 200) may comprise a deck (101), a nose (102), a hull (103), a bottom (104), optionally a fin (105) and a fin box (106), and a rocker (107). A midline or middle (125) of a paddleboard (100) can be defined as the geometric center of width of the paddleboard (100). As illustrated in FIGS. 1-10, a watercraft (100), in the present example a paddleboard (100), which can be an inflatable stand-up paddleboard (SUP) (100), can be fitted with at least one stabilizing device or rail (110) of the present disclosure. In other embodiments, the paddleboard (100) can be fitted with at least two rails (110) each disposed on edges (116) of the paddleboard bottom (104), or in other terms, the paddleboard hull (103) edges (116) where a portion of an inflatable paddleboard (100) has rounded or convex shape, the sides/edges (116) curving up from the flat bottom (104) of the paddleboard (100) that contacts the water when in use.

In another example, as illustrated in FIGS. 11-18, a watercraft (200) such as a kayak (200), that can be an inflatable kayak (200), can be fitted with at least one stabilizing device or rail (110) of the present disclosure. In other embodiments, the kayak (200) can be fitted with at least two rails (110) each disposed on the bottom of the hull (103) on sides (216) where the hull (103) begins to curve up from bottom of the hull (103) that contacts the water when in use.

Figure 10:
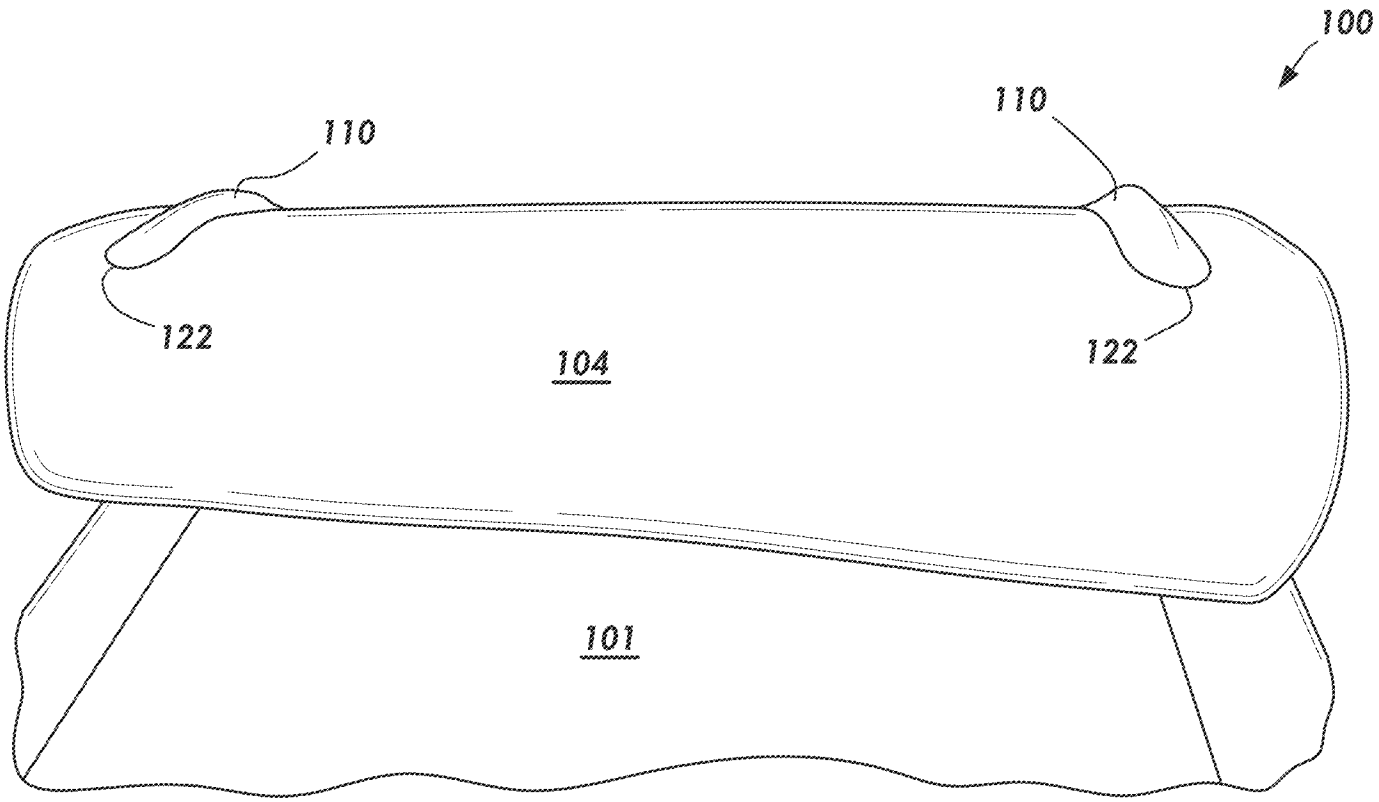
FIG. 10 is an illustration of a paddleboard watercraft with attached stability device of the present disclosure shown in a deflated and rolled position.
Figure 11:
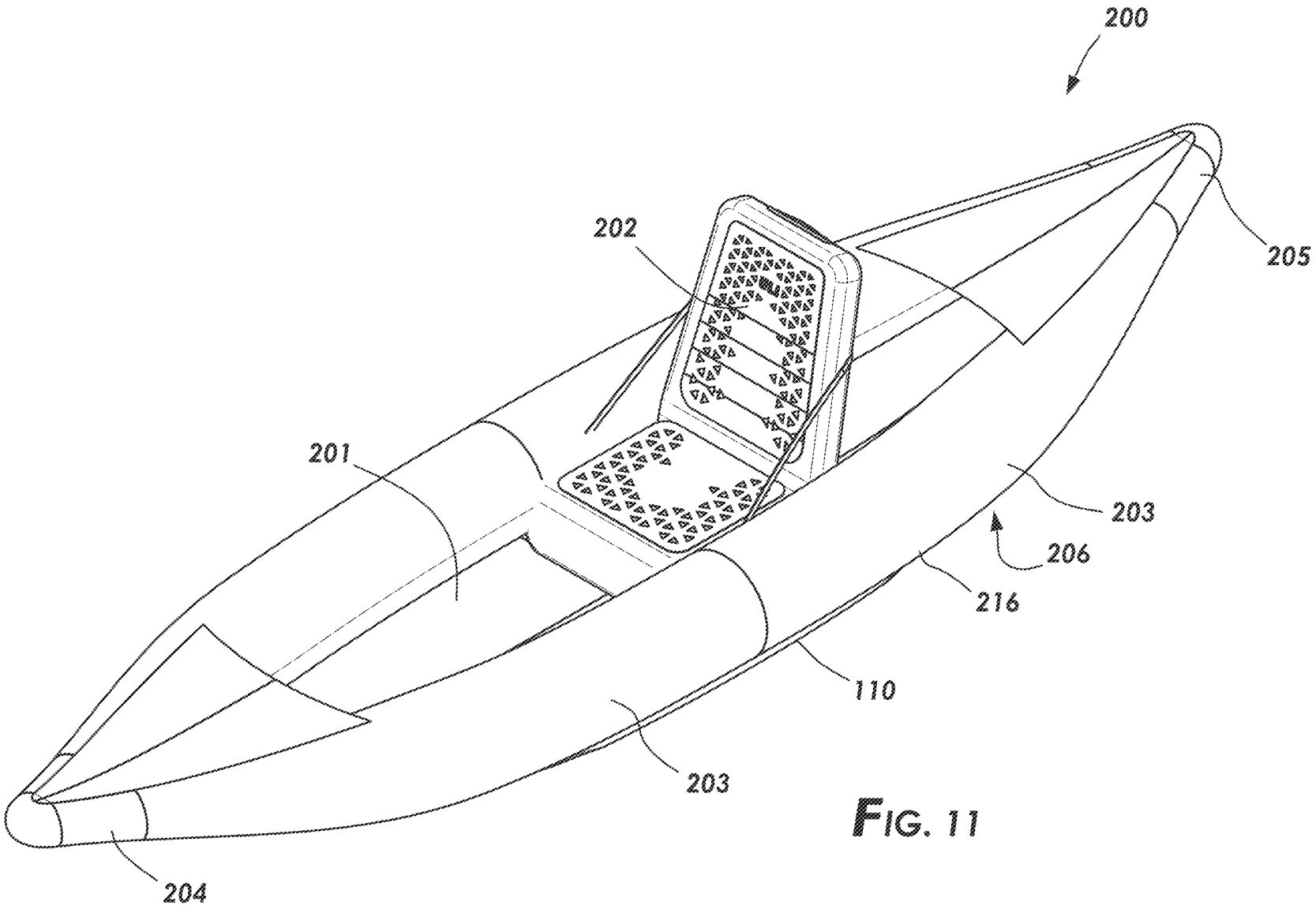
FIG. 11 is a front top perspective view of a kayak watercraft with attached stability device of the present disclosure.
Figure 12:
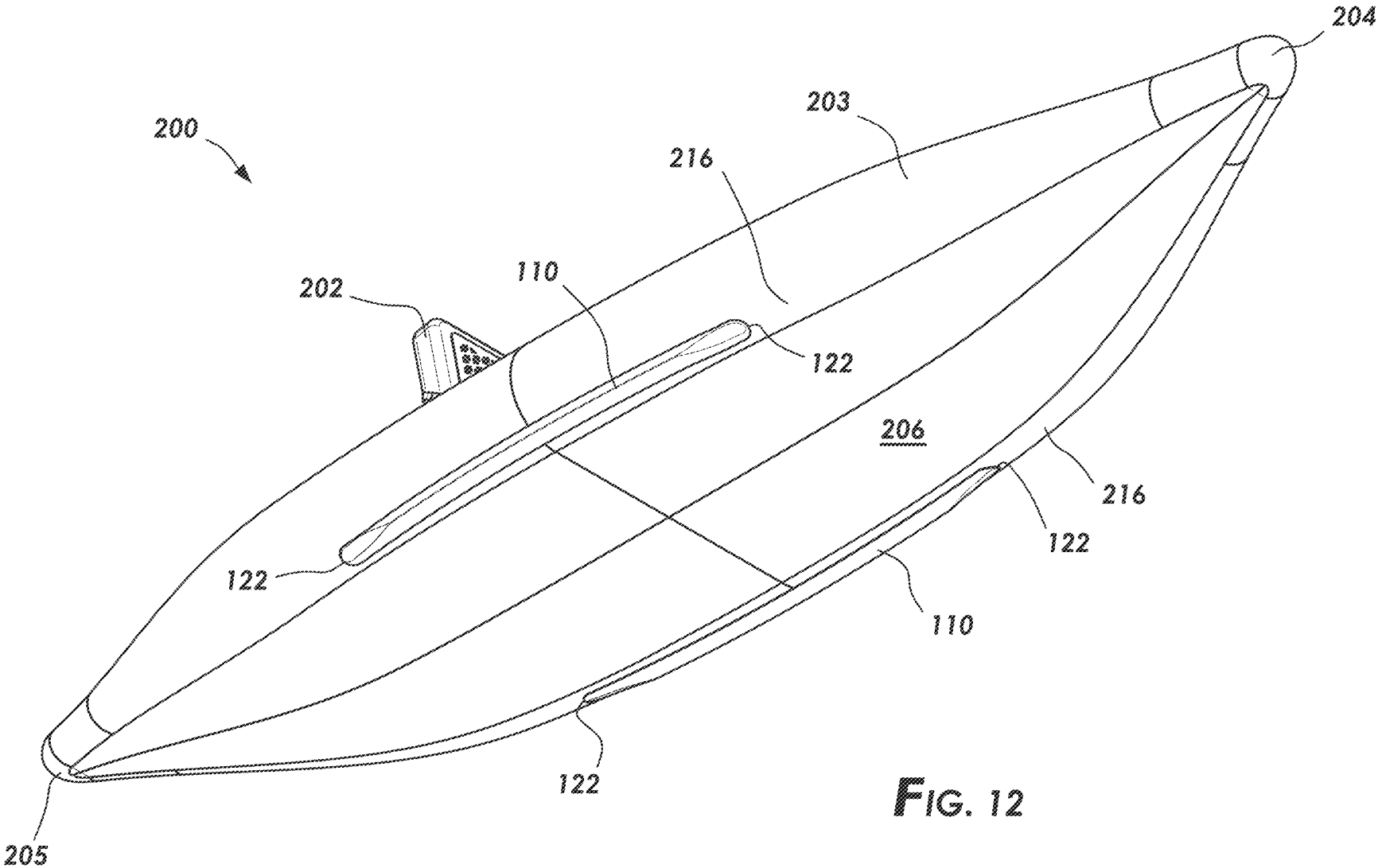
FIG. 12 is a front bottom perspective view of a kayak watercraft with attached stability device of the present disclosure.
Figure 13:
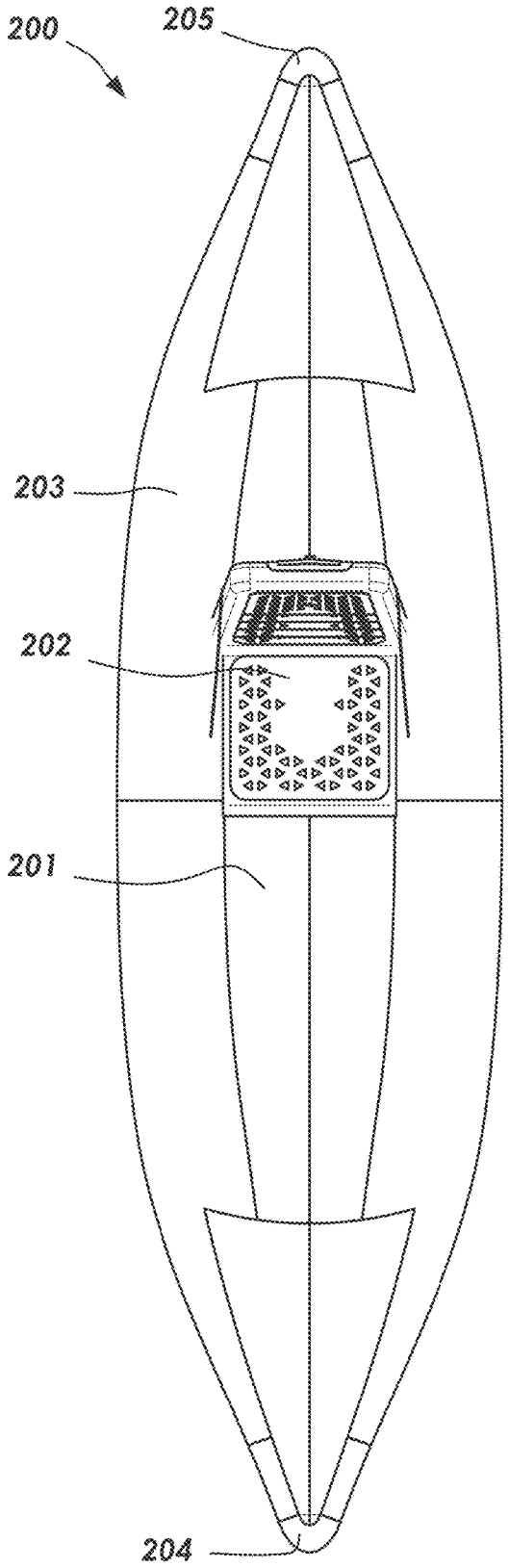
FIG. 13 is a top plan view of a kayak watercraft with attached stability device of the present disclosure.
Figure 14:
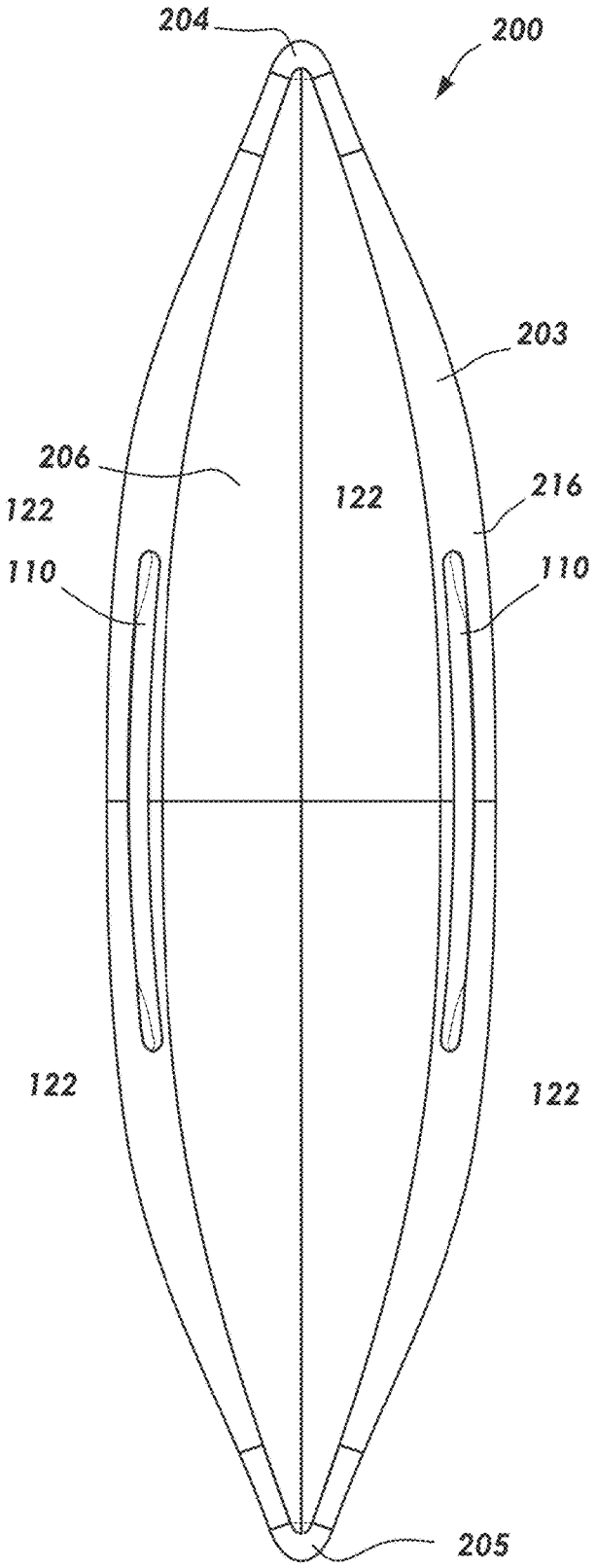
FIG. 14 is a bottom plan view of a kayak watercraft with attached stability device of the present disclosure.

FIG. 10 illustrates the flexible nature of a stability rail (110) of the present disclosure. An inflatable paddleboard (100) fitted with the stability rails (110) can be deflated and rolled for storage. The flexibility allows the stability rail (110) to be adhered to an inflatable paddleboard (100) or inflatable kayak (200) during manufacture of the watercraft (100, 200) or fit onto an inflatable watercraft (100, 200) after purchase by a consumer. Inflatable paddleboards or SUPs (100) and kayaks (200) are generally made using layered constructs of drop-stitch material. Drop-stitch material useful in the production of inflatable articles can be produced by a drop stitch method, in which a pair of fabric webs, such as polyester fabric webs, are joined by a plurality of threads. Durable, airtight polyvinylchlorides (PVC) layers in some examples can be bonded around an internal core of drop-stitch material, which uses thousands of connected fibers to give the board shape and rigidity when inflated. Other methods of board manufacture use advanced techniques like fusion lamination and bonding PVC directly to the drop-stitch core for lighter weight and increased stiffness. The deck (101) can be comprised of a cushioned, grippy ethylene-vinyl acetate (EVA) foam deck pad (not shown).

In a drop-stitch manufactured board, upon inflation of the watercraft (100, 200), the pair of fabric webs separate to form the three-dimensional shape of the watercraft (100, 200). Because these inflatable watercraft (100, 200) comprise a one-piece outer shell of generally flexible PVC material, and because having corners (126), such as a ninety-degree or other angled corner, is almost impossible in such a design, side edges (116, 216) of the watercraft (100, 200) tend to be rounded or convex in shape. These rounded edges (116, 216) limit the amount of flat surface area on bottom 104 of craft to contact the water, therefore limiting stability, tracking, maneuverability, and thus handleability of the watercraft.

To create a stability device (110) flexible in nature that can be incorporated on an inflatable paddleboard (100) or kayak (200) during or post production, the stability rail(s) (110) can be formed from flexible materials such as a material or a mixture of a materials chosen from: a rubber, an elastomer, a silicone, a neoprene, an ethylene propylene diene monomer (EPDM), a polyurethane (PU), a thermoplastic polyurethanes (TPU), a polylactic acid (PLA), an acrylonitrile butadiene styrene (ABS), a polyethylene terephthalate glycol (PETG), a nylon, a polyvinyl chloride (PVC), flexible resins, and a polycarbonate (PC). In an embodiment the stability rail (110) can be formed of a PVC, being a flexible PVC, or flexible TPU, either the flexible PVC or TPU, or other material of manufacture, or mixtures thereof, having a Shore A Hardness rating in some examples of at least thirty but not greater than one-hundred, or at least forty but not greater than ninety-five, or at least fifty but not greater than ninety, or at least sixty but not greater than ninety, or at least seventy but not greater than ninety. In some embodiments, the Shore A Hardness of a stability rail (110) of the present disclosure can be at least 30, or at least 35, or at least 40, or at least 45, or at least 50, or at least 60, or at least 65, or at least 70, or at least 71, or at least 72, or at least 73, or at least 74, or at least 75, or at least 76, or at least 77, or at least 78, or at least 79, or at least 80, or at least 81, or at least 82, or at least 83, or at least 84, or at least 85, or at least 86, or at least 87, or at least 88, or at least 89, or at least 90, or at least 91, or at least 92, or at least 93, or at least 94, or at least 95. In other terms the Shore A Hardness of the stability rail (110) is not greater than 100, or not greater than 99, or not greater than 98, or not greater than 97, or not greater than 96, or not greater than 95, or not greater than 94, or not greater than 93, or not greater than 92, or not greater than 91, or not greater than 90, or not greater than 89, or not greater than 88, or not greater than 87, or not greater than 86, or not greater than 85, or not greater than 84, or not greater than 83, or not greater than 82, or not greater than 81, or not greater than 80.

Methods for applying a stability rail to a watercraft (100, 200), such as a paddleboard (100) or kayak (200), will depend on the outer material of the watercraft (100, 200). Examples of adhesives for applying a stability rail (110) of the present disclosure to a watercraft (100, 200) may include use of PVC or solvent cement which melts PVC surfaces for a strong, fused bond or chemical weld. Other examples of adhesive can comprise a trim adhesive such as TITE-BOND® PVC trim adhesive, a one component advanced polymer adhesive sealant, or LOCTITE® instant adhesive, from Henkel Adhesives, a two-part system that requires no mixing. Other glues or adhesives may include but are not limited to silicone glue, two-part adhesives, liquid sealants, epoxy materials. The adhesive chosen should be waterproof and in some examples temperature resistant, so the adhesive will not break down or fail in high or low temperature conditions.

Some of these adhesives, such as PVC or solvent cement may require the material to be prepped prior to adhering the stability rail (110). Prepping both the watercraft (100, 200) and stability rail (110) may comprise cleaning both, use of a primer, and then adhering the stability rail (110) to the watercraft (100, 200). Other methods for applying or coupling the stability rail (110) to a watercraft (100, 200) may include but are not limited to nailing, clipping, screwing, clamping, pinning, or other attachment means or devices. The stability rail (110) can be adhered or coupled to the watercraft (100, 200) pre-market, being before a sale of the watercraft (100, 200) during production, or the stability rail (110) can be sold as a standalone product, being available for the consumer to add the rail (110) to a watercraft (100, 200) via using an adhesive or other coupling means as described herein.

Figure 25:
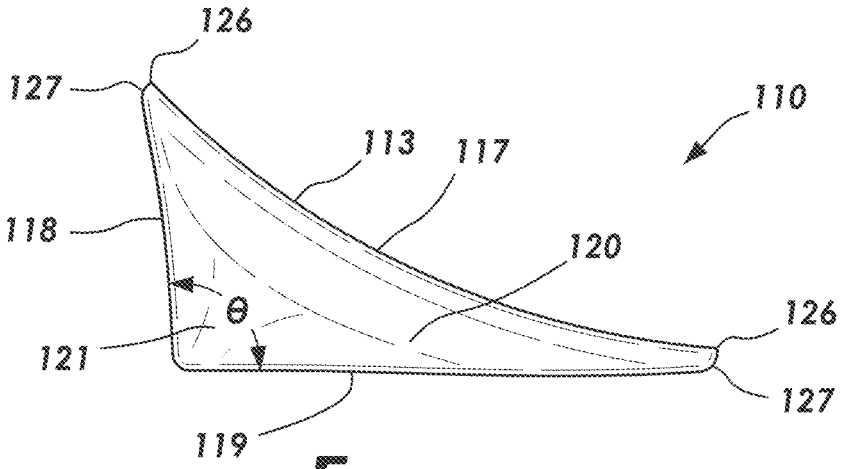
FIG. 25 is a front elevation view of a stability device of the present disclosure.
Figure 26:
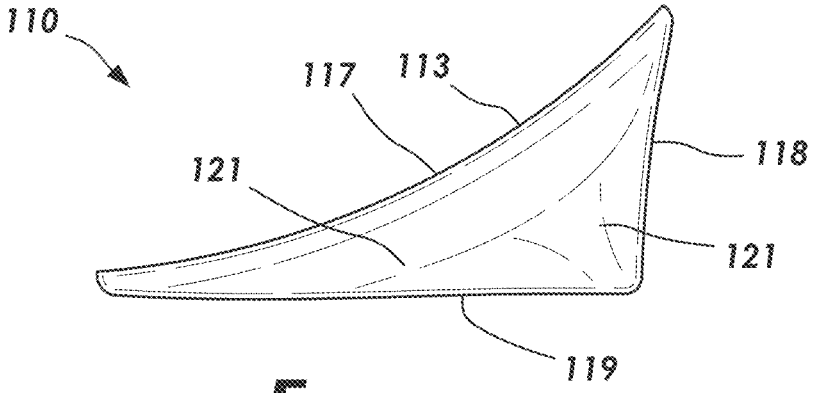
FIG. 26 is a rear elevation view of a stability device of the present disclosure.
Figure 27:
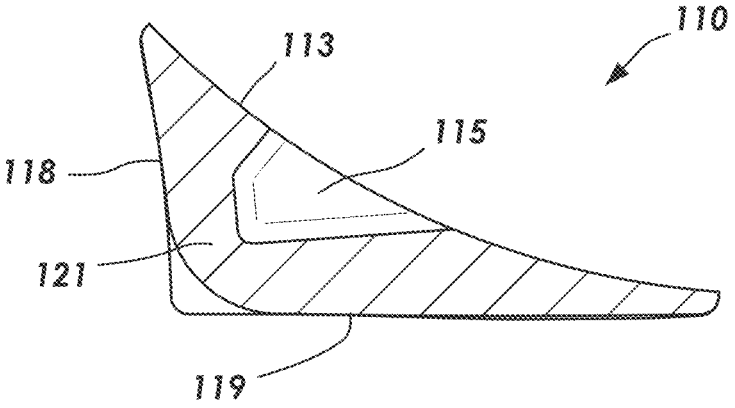
FIG. 27 is a cross-sectional view of a stability device of the present disclosure depicted in FIG. 23.
Figure 28:
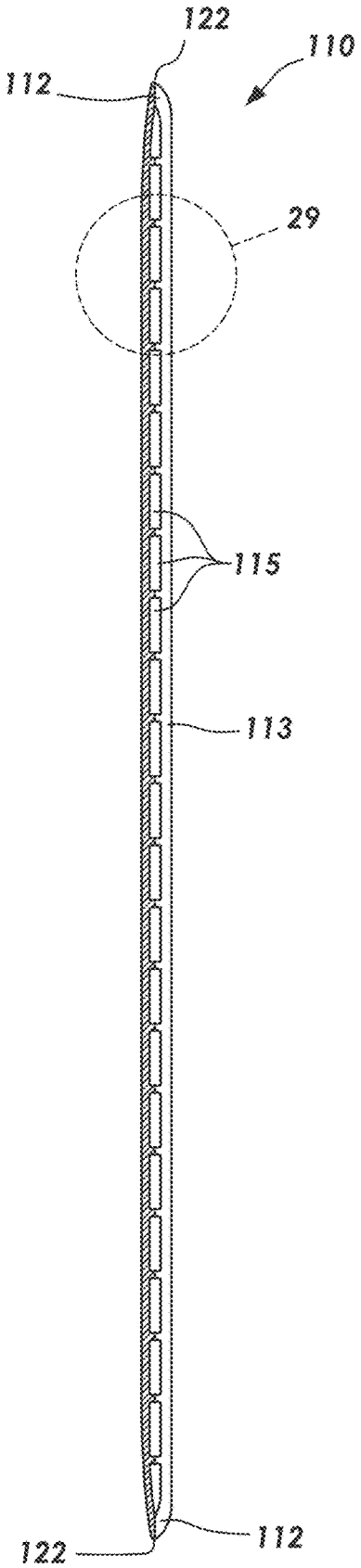
FIG. 28 is a cross-sectional view of a stability device of the present disclosure depicted in FIG. 24.
Figure 29:
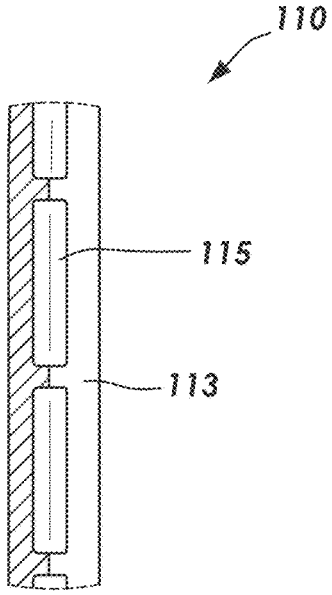
FIG. 29 is an enlarged cross-sectional view of a stability device of the present disclosure depicted in FIG. 28.

As shown in FIGS. 19-29, a stability rail (110) of the present disclosure can be described as comprising at least two types of portions or sections, a mid-section (111), and end-sections (112). Two end-sections (112) or end-section pieces (112) flank the mid-section (111). FIGS. 25-27 illustrate the mid-section sides (117, 118, 119) being a first mid-section side (117), second mid-section side (118), and third, substantially flat or planar, mid-section side (119). The first mid-section side (117) can be designed to couple to, or match the design of, the convex edge (116, 216) of an inflatable paddleboard (100) or kayak (200), so may exhibit a concave shape, but other configurations can be appropriate for other watercraft.

The second mid-section side (118) can be approximately vertical to the third substantially flat mid-section side (119), having an angled relation or angled coupling between the second mid-section side (118) and the third mid-section side (119). The second mid-section side (118) being disposed with an angle θ, as illustrated in FIG. 25, of about 90°, or ninety degrees, when the second mid-section side (118) lies vertically opposed to the horizontal third mid-section side (119). In other embodiments, the second mid-section side (118) may comprise an angled relation to the third mid-section side (119) wherein the angle θ is at least sixty-five degrees, or at least seventy degrees, or at least seventy-five degrees, or at least eighty degrees, or at least eighty-five degrees, or at least ninety degrees, or at least ninety-five degrees, or at least one-hundred degrees, or at least one-hundred-five degrees, or at least one-hundred ten degrees, or at least one-hundred fifteen degrees, or one-hundred twenty degrees, or more.

As shown in FIGS. 25-26, the second mid-section side (118) may comprise approximately a planar wall. In other embodiments the second mid-section side (118) can be slightly concave, or concave, in shape. The third mid-section side (119) may comprise an essentially planar form. The first and second mid-section sides (117, 118) may meet in an angled relation, the angle comprising an acute angle. The third and first mid-section sides (119, 117) may meet in an angled relation, the angle comprising an acute angle. The exterior form of corners where the first mid-sections side (117) and the second mid-sections side (118) meet may form an angled corner (126) or a rounded corner (126). Likewise, the exterior form of corners (126) where the third mid-section side (119) and the first mid-section side (117) meet may form an angled corner (126) or a rounded corner (126). The end portions (127) of the second and third mid-section walls may comprise slightly convex portions meeting the corners 126.

As shown in FIGS. 19-29, the end-sections comprise at least two sides, an end first side (120) which can be coupled to the first mid-section side (117), and an end second side (121) that can be coupled to the second mid-section side (118) and the third mid-section side (119). This coupling may comprise a fluid coupling such that the stability rail (110) can be formed of one piece via molding, extrusion, 3D printing, or other known means of manufacture. In other embodiments the mid-section (111) and end sections (112) can be coupled via other means before or after placement on a watercraft including but not limited to adhesion via an adhesive or other attachment means described herein. In other embodiments the mid-section (111) and end-sections (112) can be placed or adhered in close proximity on a watercraft.

Flexible devices such as the stability rail (110) of the present disclosure can be manufactured using extrusion or forming, such as use of a mold. An example PVC extrusion method may comprise wherein the PVC mix is melted, forced through a die to form the stability rail (110) shape, cooled, cut, and finished. In some mixtures and/or techniques, plasticizers are added during mixing for flexibility, precise temperature control, and specialized cooling is used, such as water baths, to achieve desired properties like softness and transparency, if desired. Other methods of manufacture may include thermoforming, wherein a flexible PVC is heated until pliable, a vacuum sucks air out from under a PVC sheet, pulling the sheet into a mold. Pressure forming may also be used wherein air pressure is used to press a heated sheet tightly against a mold.

Plasticizers can be an ingredient used to form a flexible stability rail (110) of the present disclosure. Phthalates or non-phthalate alternatives can be utilized to form a flexible material or mixture. These can be added during the mixing stage and increase chain mobility and softness. Steps in a general extrusion process used in the manufacture of PVC include but are not limited: 1) mixing the resin, plasticizers, stabilizers, if desired or needed, and other additives; 2) shaping and melting, wherein the mix is fed into a twin-screw extruder for example, to form the profile; 3) cooling; and 4) finishing to form the final product. Injection molding can be utilized wherein a double-sided mold, made from steel aluminum or copper alloy, is used. The stability rail (110) material can be melted to a liquid state and injected into the mold creating an accurate finished shape upon cooling.

Figure 7:
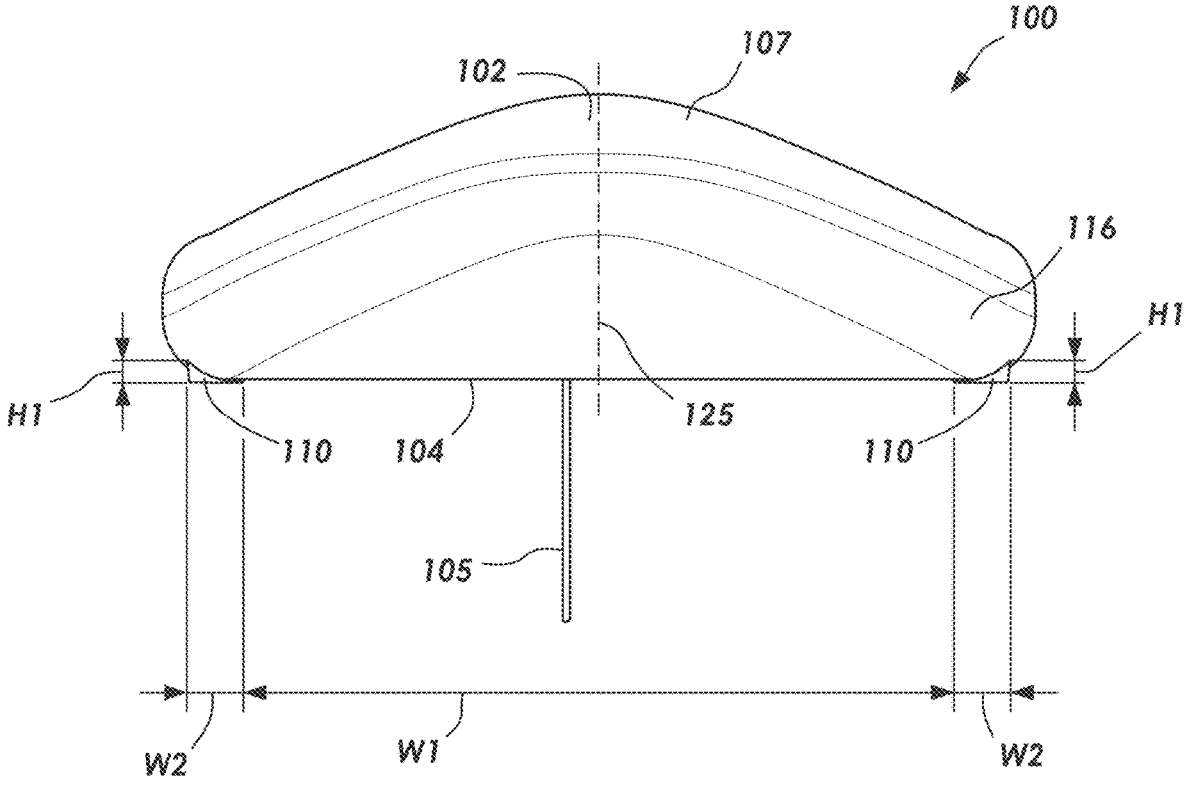
FIG. 7 is a front end elevation view of a paddleboard watercraft with attached stability device of the present disclosure.
Figure 8:
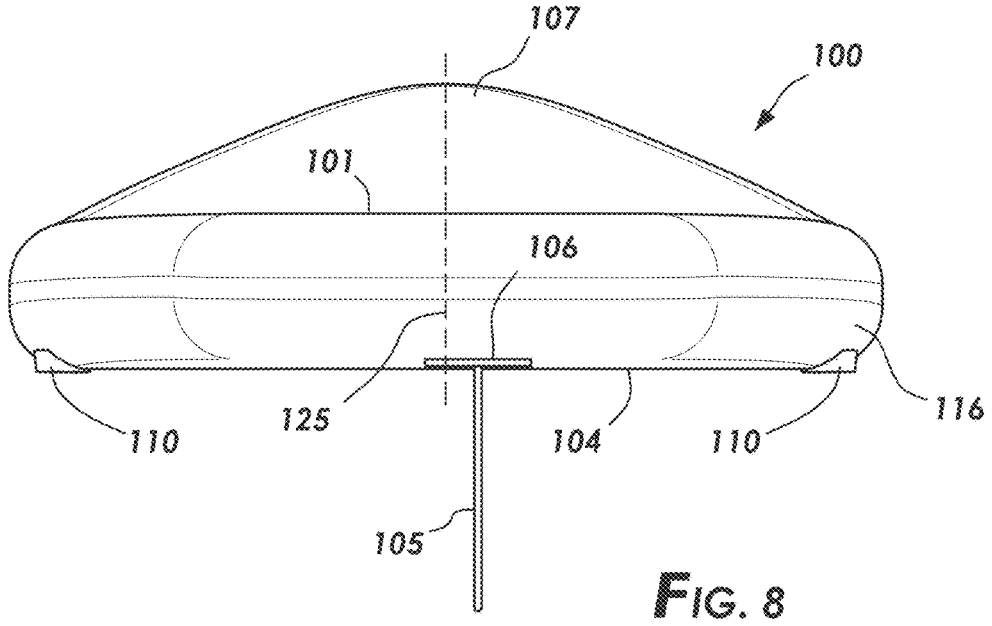
FIG. 8 is a back end elevation view of a paddleboard watercraft with attached stability device of the present disclosure.

As illustrated in FIG. 7, the stability rail(s) (110) of the present disclosure improve(s) stability, tracking, maneuverability, and handleability of a watercraft, shown here as a paddleboard (100), by increasing the amount of flat surface area available to contact the water. In general, paddleboards (100) can be of a short length, being less than ten feet in length. These short length boards are good for smaller paddlers, such as children, and are great for choppier surf use because they are more maneuverable. Medium boards range from ten to twelve feet in length. Medium boards are used for general use by an adult user for casual paddling and yoga applications. Long boards are twelve feet or greater in length and are used for speed. Longer boards may track faster and are best for touring and racing.

Width of paddleboards (100) vary with wider boards of thirty-two inches or greater being more stable and good for beginners. Narrow boards, less than thirty inches wide, are less stable, faster, and are good for experienced paddlers. A mid-range or medium-width board comprises a board of thirty to thirty-two inches in width and is a well-balanced board good for many recreational paddlers. Typical thickness or height of boards vary from four to six inches, with thicker boards supporting more weight and providing more buoyancy.

For beginners and lighter boarders, a board of nine feet to ten and a half feet in length is recommended with twenty-nine to thirty-two inch width, (W1), and four to five inch thickness for stability. For an average size user, a board of ten and a half feet to twelve and a half feet in length, thirty to thirty two inches in width, and four to five inches in thickness is recommended for balance and performance. For larger users, a board of twelve and a half feet or longer, thirty-two to thirty-four inches in width, and five to six inches in thickness is recommended to increase volume and improve stability.

As such, a stability rail (110) of the present disclosure, especially shown in FIGS. 19-29, can be at least two feet long, or at least two feet one inch, or at least two feet two inches, at least two feet three inches, or at least two feet four inches, or at least two feet five inches, or at least two feet six inches, or at least two feet seven inches, at least two feet eight inches, at least two feet nine inches, at least two feet ten inches, at least two feet eleven inches, or at least three feet, in length.

In other terms, the stability rail (110) can be at least one-fourth or one-quarter the length of a watercraft (100, 200), or at least one-third the length of watercraft (100, 200). The stability rail can be about one-half the length of the watercraft (100, 200), or more. The stability rail (110) measured by the width of the mid-section third substantially flat side (119) can be at least an inch wide as illustrated by W2 of FIG. 7. The stability rail (110) in other examples can be at least 1.1, at least 1.2, at least 1.25, at least 1.3, at least 1.4, at least 1.5, at least 1.6, at least 1.7, at least 1.75, at least 1.8, at least 1.9, or at least 2.0 inches wide on the mid-section third side (119, W2). A height of the second mid-section side H1, FIG. 7, can be at least one-half inch, or at least 0.5 inches, or at least 0.6 inches, or at least 0.7 inches, or at least 0.8 inches, or at least 0.9 inches, or at least one inch, or at least 1.1, or at least 1.2, or at least 1.25, or at least 1.3, or at least 1.4, or at least 1.5, or at least 1.6, or at least 1.7, or at least 1.75, or at least 1.8, or at least 1.9, or at least 2.0 inches.

The mid-section (111) length may comprise at least about half the total length of the stability rail (110), or at least about one-third the total length of the stability rail. The two end-sections may have the same length and represent at least one-twentieth, or one-fifteen, or one-tenth of the length of the stability rail (110). The lengths of the two end-sections (112) may differ, with each end section (112) having a length of at least one-twentieth, or one-fifteen, or one-tenth of the total length of the stability rail (110).

As illustrated in FIGS. 19-29, end-sections (112) flanking the mid-section (111), may comprise at least two sides (120, 121). These two sides can be joined in a fluid manner, being coherently coupled with the three mid-section sides (117, 118, 119), in a single piece stability rail (110) production method. In other examples, the two end sections (112) can be formed in a separate piece and fit or adhered next to a mid-section (111), or in some other manner coupled to the mid-section (111), pre- or post-, or in coordinate-fitting to a watercraft (100, 200). The two end sections sides (120, 121) may taper from the mid-section (111) to terminal ends (122). The terminal end (122) of the stability rail can be rounded or convex in shape. In other examples, the terminal end (122) may have a straight, diagonal, or other shaped end. The first side of the end section (120), with the first side of the middle section (117) forms the inside portion of the rail (113) and adheres to the watercraft (100, 200), being designed to fit a shape of an outer portion of hull (103) of a watercraft (100, 200). In some examples, the first side of the end section (120) and first side of the middle section (117) can be concave in shape designed to fit a convex shaped watercraft (100, 200) edge. The second side of the end section (121) can be coupled to the second and third sides of the mid-section (118, 119) and forms an outside portion (114) of the rail (110). The second side of the end section (121) can be rounded or convex in shape, tapering down to meet the first side of the end section (120) to form the terminal end (122).

Figures 19, 20:
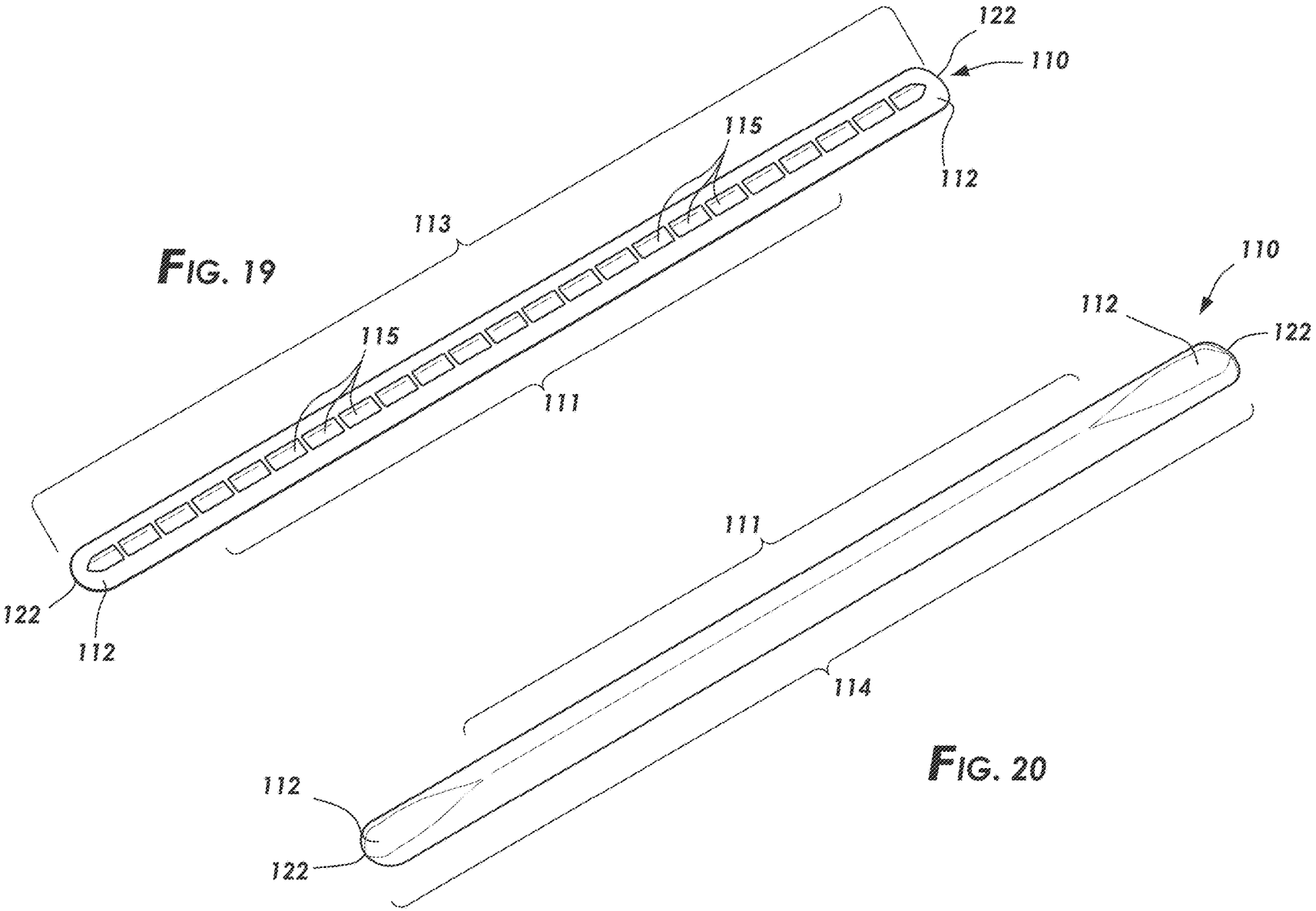
FIG. 19 is a top-side perspective view of a stability device of the present disclosure.
FIG. 20 is a bottom-side perspective view of a stability device of the present disclosure.
Figure 21:
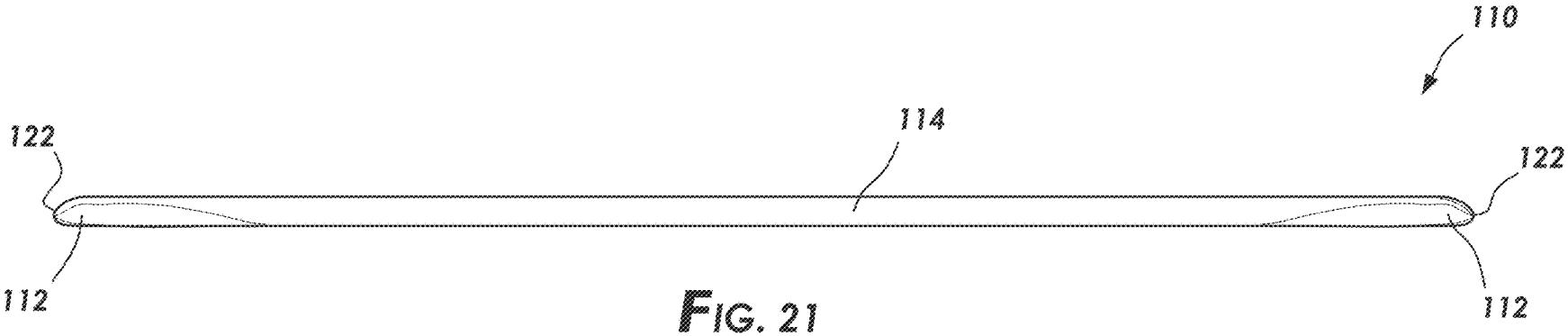
FIG. 21 is a left-side elevation view of a stability device of the present disclosure.
Figure 22:
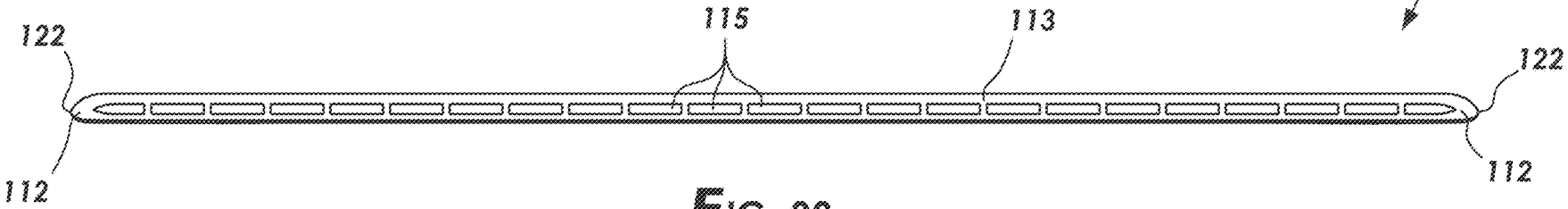
FIG. 22 is a right-side elevation view of a stability device of the present disclosure.
Figure 23:
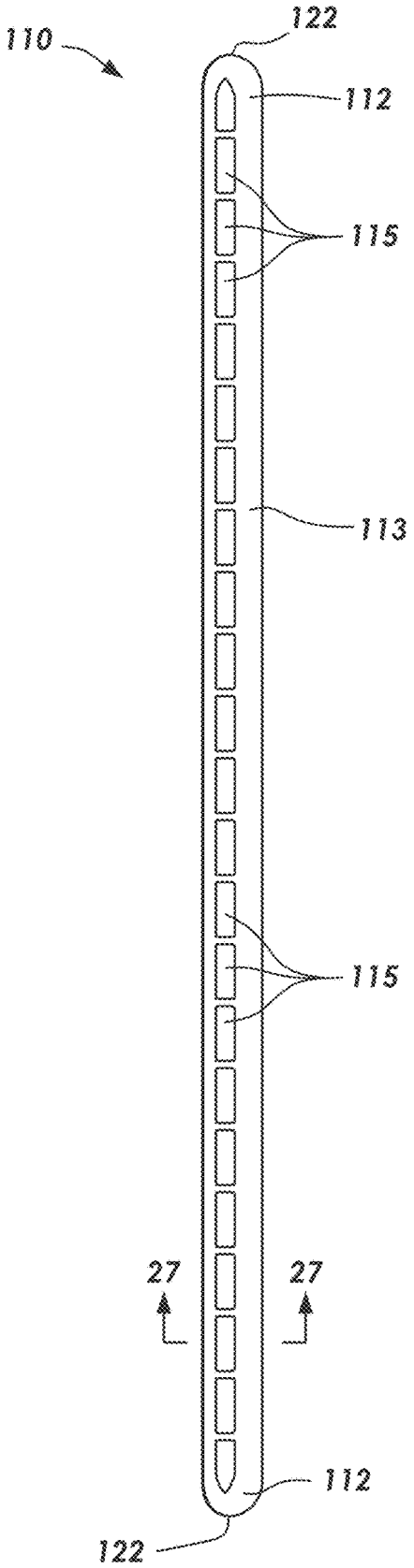
FIG. 23 is a bottom plan view of a stability device of the present disclosure.
Figure 24:
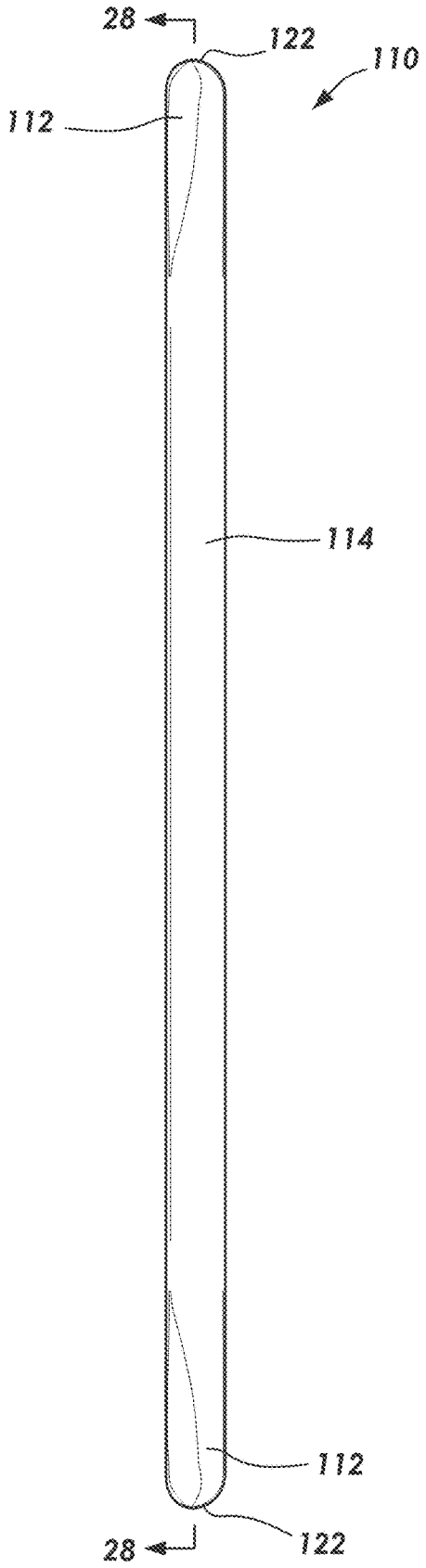
FIG. 24 is a top plan view of a stability device of the present disclosure.

As illustrated in FIG. 19, at least one cavity (115) can be formed in the inside portion (113) of at least the mid-section (111) of the stability rail (110). In other examples a plurality of cavities (115) can be formed in the inside portion (113) of at least the mid-section (111) of the stability rail (110). In other examples, cavities (115) may also be formed in at least one of the end sections (112) of the stability rail (110). In other example cavities (115) are formed in both of the end sections (112). In other examples, a plurality of cavities (115) are formed in the inside portion (113) of the stability rail. The at least one cavity (115) or plurality of cavities (115) may comprise a width of at least one-tenth of the width of the stability rail (110), or at least one-ninth, or at least one-eight, or at least one-seventh, or at least one-sixth, or at least one-fifth, or at least one-fourth, or at least one-third, or at least one-half of the stability rail (110). One long cavity (115) can be formed in a portion of the mid-section (111), being disposed in more than fifty-percent of the length of the mid-section (111). At least one cavity (115) can be formed in the at least one end-section (112), being disposed in more than fifty-percent of the length of the end-section (112).

VI. EXAMPLES

Example I

Figure 9:
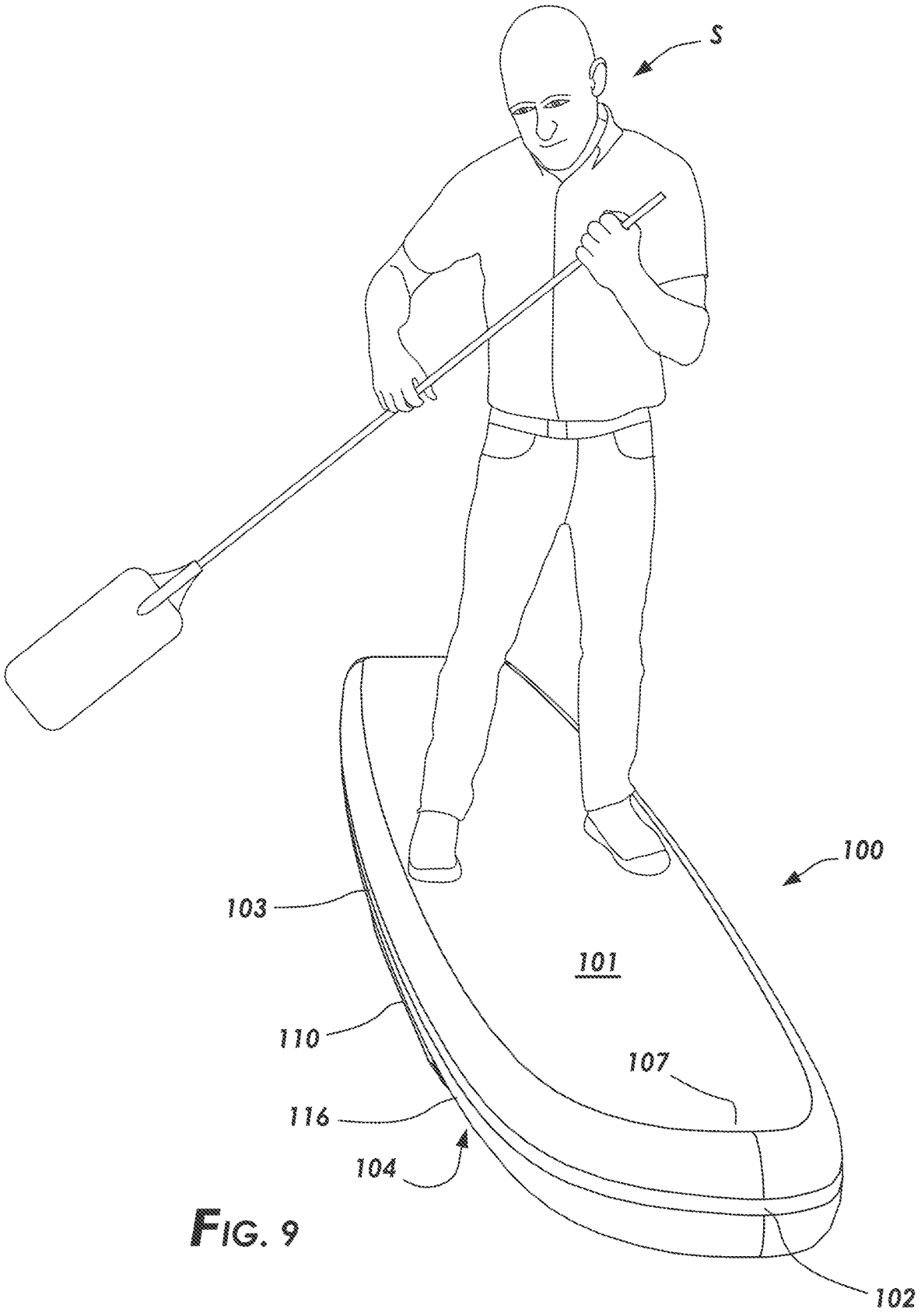
FIG. 9 is a perspective view of a paddleboard watercraft with attached stability device of the present disclosure shown in use.

A mid-size inflatable paddleboard (100) of ten and half feet in length was fitted with two stability rails (110) of the present disclosure as illustrated in FIGS. 1-10. FIG. 9 illustrates the paddleboard (100) fitted with the stability rails (110) in use with a subject (S) standing on the deck (101) of the paddleboard. As illustrated in FIG. 10, the inflatable paddleboard (100) fitted with the stability rails (110) could be deflated and rolled for storage.

With reference to FIGS. 19-20, the mid-section of each stability rail (110) measured 28". Each end section (112) measured 5.5", for a total length of each stability rail (110) of 39". With reference to FIG. 7, the width of the third mid-section side (W2) measure 1.5" and the height of the second mid-section side (H1) measured 1".

As illustrated in FIG. 7, the width of the bottom (W1) of the example paddleboard that would contact a body of water when in use, when the stability rails (110) were not present, was approximately 24" and the length was approximately ten feet or 120". The total surface area contacting the water without the stability rails (110) was therefore approximately 2,880".

The addition of a single stability rail (110) mid-section third planar side as illustrated in FIG. 7 adds an extra 1.5"×28" of water contact surface area or 42 square inches per rail (110), for a total of 84 square inches additional surface area of contact with the water when two stability rails (110) were fixed to the paddleboard (100). This equaled an additional 2.9% water contact surface area on a 10.5' paddleboard (100), thereby providing greater stability to the paddleboard (100) when in use as illustrated in FIG. 9.

Additional tracking advantage was gained in fin area added by the presence of the stability rails (110). For purposes of the present disclosure, a fin area is the vertical surface area of a fin (105) on the paddleboard. Paddleboards (100) are generally fit with one fin (105), but can be fit with an additional two fins (105) or more. The paddleboard of the present example comprised one center fin (105) as shown in FIG. 7. More fins, and therefore greater fin area, offer better tracking or maneuverability and handleability to a paddleboard. Generally, as was the case in the present example, when one fin (105) is utilized with placement in the center of the board, a 7" fin (105) is used for standard paddleboarding. With base of the fin measuring approximately 5.25" (133 mm) and length 6.9" (175 mm), the fin surface area was 36.2". The addition of the stability rails (110) with height H1 of 1" and length of 28" of mid-section equaled an additional 28" of surface area for one stability rail (110) and 56" of surface area for two stability rails (110) on the paddleboard (100), greater than doubling the fin area of the paddleboard for an additional 155% fin surface area over the single fin.

Example II

As illustrated in FIGS. 11-18, a stability rail (110) or stability rails (110), can be fit to a kayak (200) watercraft, or an inflatable kayak (200), in certain examples. Compact single-seater inflatable kayaks range from about seven feet to ten feet in length and two and a half to three feet in width. Larger tandem kayaks and family models may vary from twelve to sixteen feet in length and twenty-eight to forty inches in width. Greater width of a kayak can increase stability and greater length can increase speed and tracking. For purposes of the present disclosure, a standard, single-seater kayak (200) measuring eleven feet is used as a comparison. With width of a single-seater kayak generally measuring 28"-32", we assumed a width of 30", with 24" of water contact width. Therefore, the square area of water contact space would equal 132" (11') times 24" for an area of 3,168 inches square.

Figure 15:
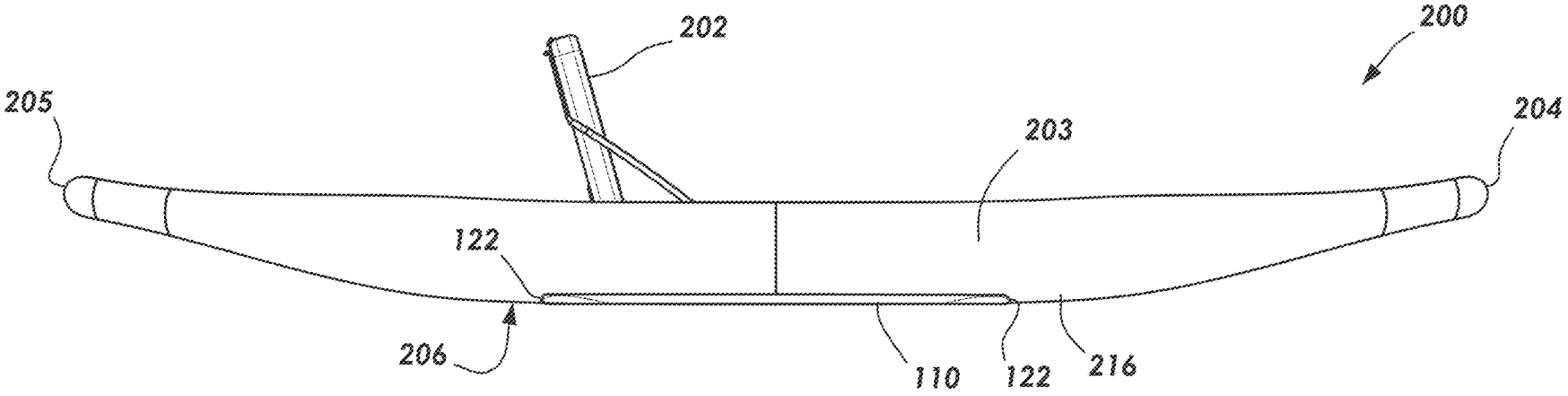
FIG. 15 is a right-side elevation view of a kayak watercraft with attached stability device of the present disclosure.
Figure 16:
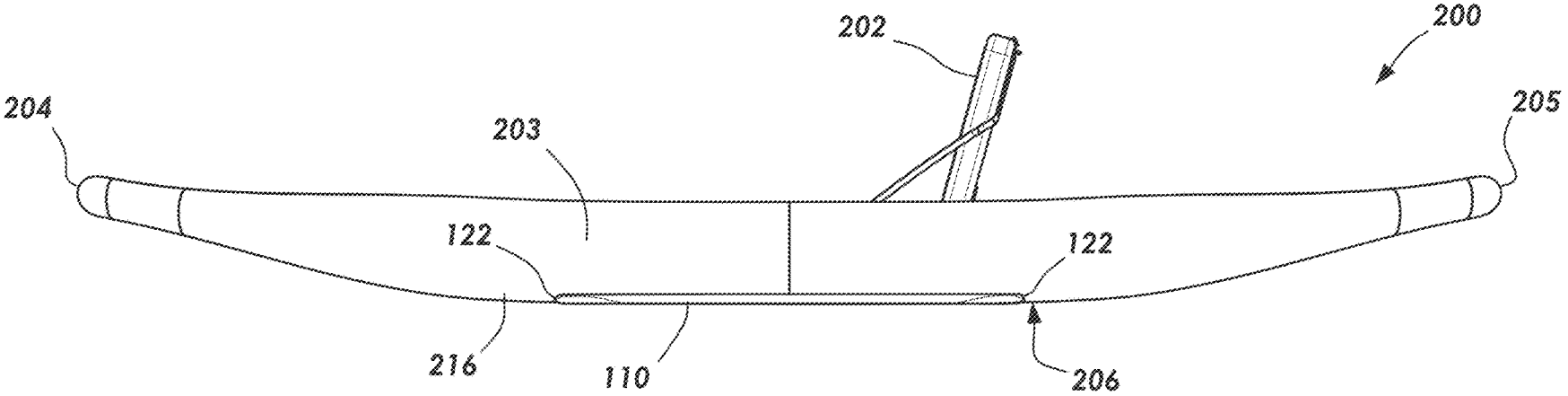
FIG. 16 is a left-side elevation view of a kayak watercraft with attached stability device of the present disclosure.
Figure 18:
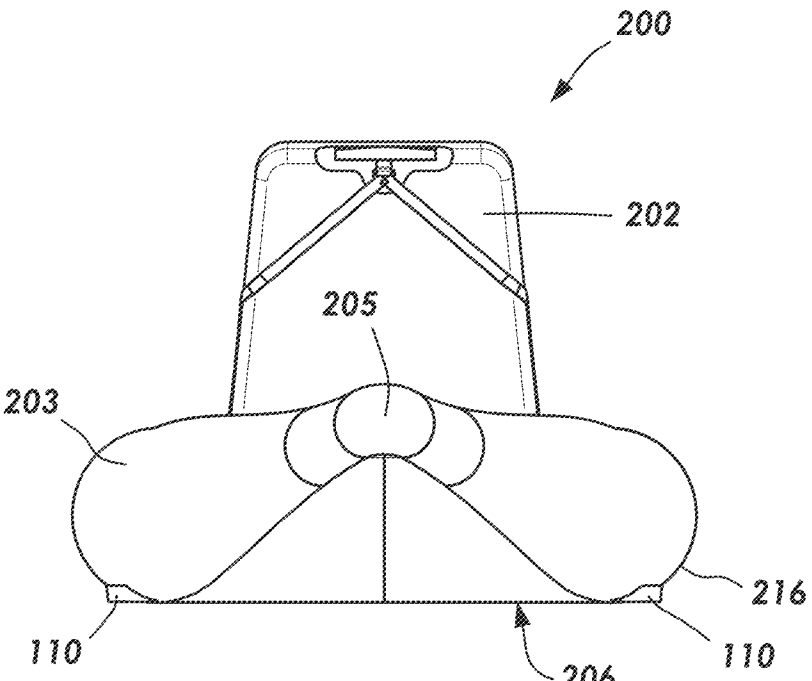
FIG. 18 is a back elevation view of a kayak watercraft with attached stability device of the present disclosure.
Figure 17:
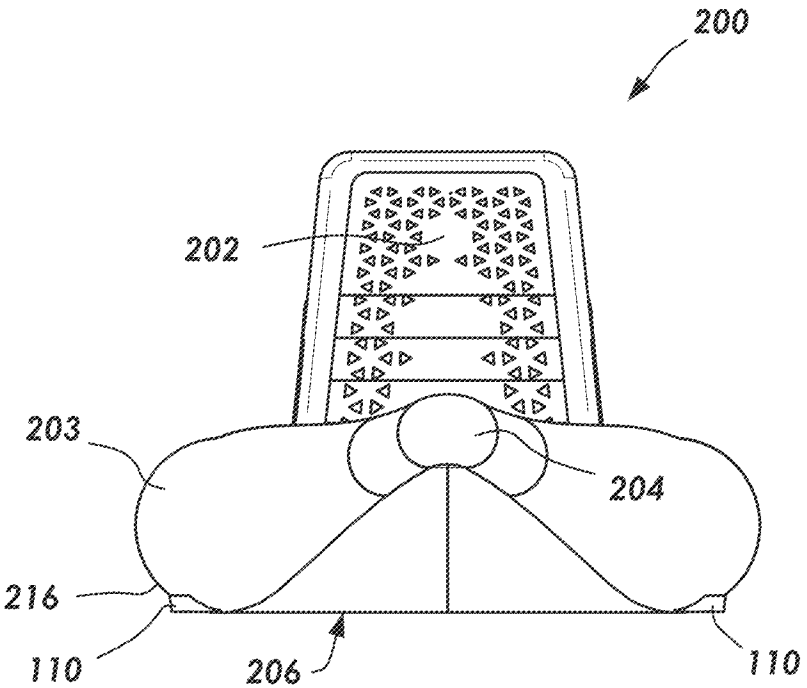
FIG. 17 is a front elevation view of a kayak watercraft with attached stability device of the present disclosure.

The addition of the stability rails (110) mid-sections third planar side (119) as illustrated in FIGS. 15-16 adds an extra 1.5"×28" of water contact surface area or 42 square inches per rail (110) for a total of 84 square inches additional surface area of contact with the water. This would equal an additional 2.65% water contact surface area on a 11' kayak (200), thereby providing greater stability to the kayak (200) when in use.

Kayaks (200) may use fins (105), also termed skegs or rudders, for tracking although many kayaks and kayakers rely solely on paddles for tracking and maneuvering. Kayaks generally use one or two fins (105) in line or opposite each other. The addition of a stability rail (110) with height H1 of 1" and length of 28" of mid-section would provide an additional 28" of fin surface area for one stability rail (110) and 56" of surface area for two stability rails (110) to a kayak (200) and could replace a fin (105) on a kayak (200). If one used a fin (105) measuring approximately 5.25" (133 mm) and length 6.9" (175 mm), the fin surface area would be 36.2". As with the paddleboard (100) in Example 1, the fin areas would be greater than doubled for an additional 155% fin surface area over the single fin (105).

As can be easily understood from the foregoing, the basic concepts of the present disclosure can be embodied in a variety of ways. The disclosure involves numerous and varied embodiments of a watercraft stability device and methods for making and using such a watercraft stability device.

As such, the particular embodiments or elements of the disclosure disclosed by the description or shown in the figures or tables accompanying this application are not intended to be limiting, but rather exemplary of the numerous and varied embodiments generically encompassed by the disclosure or equivalents encompassed with respect to any particular element thereof. In addition, the specific description of a single embodiment or element of the disclosure may not explicitly describe all embodiments or elements possible; many alternatives are implicitly disclosed by the description and figures.

It should be understood that each element of an apparatus or each step of a method can be described by an apparatus term or method term. Such terms can be substituted where desired to make explicit the implicitly broad coverage to which this disclosure is entitled. As but one example, it should be understood that all steps of a method can be disclosed as an action, a means for taking that action, or as an element which causes that action. Similarly, each element of an apparatus can be disclosed as the physical element or the action which that physical element facilitates. As but one example, the disclosure of a "watercraft stability device" should be understood to encompass disclosure of the act of "stabilizing a watercraft"—whether explicitly discussed or not—and, conversely, were there effectively disclosure of the act of "stabilizing a watercraft", such a disclosure should be understood to encompass disclosure of a "watercraft stability device" and even a "means for stabilizing a watercraft." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present disclosure, ranges can be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present disclosure, the term "a" or "an" entity refers to one or more of that entity unless otherwise limited. As such, the terms "a" or "an", "one or more" and "at least one" can be used interchangeably herein.

Further, for the purposes of the present disclosure, the term "coupled" or derivatives thereof can mean indirectly coupled, coupled, directly coupled, connected, directly connected, or integrated with, depending upon the embodiment.

Additionally, for the purposes of the present disclosure, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the watercraft stability device herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent disclosures, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the disclosure pertains. This section may also incorporate or contain paraphrasing of certain United States patents, patent applications, publications, or subject matter of the claimed disclosure useful in relating information, problems, or concerns about the state of technology to which the disclosure is drawn toward. It is not intended that any United States patent, patent application, publication, statement or other information cited or incorporated herein be interpreted, construed or deemed to be admitted as prior art with respect to the disclosure.

The claims set forth in this specification, if any, are hereby incorporated by reference as part of this description of the disclosure, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The elements following an open transitional phrase such as "comprising" may in the alternative be claimed with a closed transitional phrase such as "consisting essentially of" or "consisting of" whether or not explicitly indicated the description portion of the specification.

Additionally, the claims set forth in this specification, if any, are further intended to describe the metes and bounds of a limited number of the preferred embodiments of the disclosure and are not to be construed as the broadest embodiment of the disclosure or a complete listing of embodiments of the disclosure that can be claimed. The applicant does not waive any right to develop further claims based upon the description set forth above as a part of any continuation, division, or continuation-in-part, or similar application.

I claim:

1. A stability device for an inflatable watercraft, the stability device comprising:

at least one rail comprising a mid-section and two end sections, wherein the two end sections flank the mid-section;

wherein the mid-section comprises three sides, a first mid-section side adapted to medially engage along a convex edge of the watercraft, a second mid-section side, and a third substantially flat mid-section side;

wherein the second mid-section side and the third substantially flat mid-section side meet in angled relation with each other;

wherein the at least one rail is flexible;

wherein the two end sections comprise a first end section and a second end section;

wherein the first end section comprises a first end section first side and a first end section second side;

wherein the second end section comprises a second end section first side and a second end section second side; and wherein the first end section first side and second end section first side adapted to engage the convex edge of the watercraft and coupled to the first mid-section side, and the first end section second side and second end section second side coupled to the second mid-section side and third substantially flat mid-section side.

2. A stability device for an inflatable watercraft, the stability device comprising:

at least one rail comprising a mid-section and two end sections, wherein the two end sections flank the mid-section;

wherein the mid-section comprises three sides, a first mid-section side designed to engage a convex edge of the watercraft, a second mid-section side, and a third substantially flat mid-section side;

wherein the two end sections comprise a first end section and a second end section; and wherein the first end section comprises a first end section first side and a first end section second side and the second end section comprises a second end section first side and a second end section second side, wherein the first end section first side and the second end section first side are coupled to the first mid-section side, and the first end section second side and the second end section second side are coupled to the second mid-section side and the third substantially flat mid-section side, and wherein the first end section first side and the second end section first side and the first end section second side and the second end section second side taper to terminal ends of the at least one rail.

3. The stability device of claim 2, wherein the second mid-section side is slightly concave, the second end-section side is convex, and the corner is rounded.

4. The stability device of claim 2, wherein the at least one rail comprises a material with a Shore A hardness of at least about forty and not more than about ninety-five.

5. The stability device of claim 2, wherein the at least one rail comprises a material with a Shore A hardness of at least about fifty and not more than about ninety-five.

6. The stability device of claim 2, wherein the at least one rail is formed from a material with a Shore A hardness of at least about sixty and not more than about ninety-five.

7. The stability device of claim 2, wherein the at least one rail comprises a material with a Shore A hardness of at least about seventy and not more than about ninety-five.

8. The stability device of claim 2, wherein the at least one rail comprises a material with a Shore A hardness of at least about seventy-five and not more than about ninety.

9. The stability device of claim 2, wherein the at least one rail comprises at least one of a polyvinylchloride (PVC), a thermoplastic polyurethane (TPU), an elastomer, a rubber, a polyurethane, and a resin, or combinations or mixtures thereof.

10. The stability device of claim 2, wherein the at least one rail comprises a PVC.

11. The stability device of claim 2, wherein the at least one rail comprises TPU.

12. A stability device for an inflatable watercraft, the stability device comprising:

at least one rail comprising a mid-section and two end sections, wherein the mid-section comprises a first concave mid-section side; and wherein the at least one rail comprises at least one cavity in the first concave mid-section side, wherein the at least one cavity width is not greater than one-half a width of the first concave mid-section side.

13. The stability device of claim 12, wherein the at least one rail comprises at least one additional cavity in the first concave end-section side, wherein the at least one additional cavity width is not greater than one-half a width of the first concave end-section side.

14. The stability device of claim 12, wherein the at least one rail comprises a plurality of cavities occupying the inside portion, wherein any one of the plurality of cavities does not have a width greater than one-half the width of the inside portion.

15. The stability device of claim 12, wherein a plurality of cavities of the at least one cavity are equally spaced along the inside portion of the at least one rail.

16. The stability device of claim 12, wherein the stability device comprises at least two rails.

17. The stability device of claim 16, wherein the at least two rails increase a surface area of the watercraft in contact with a water body by at least two percent.

18. The stability device of claim 16, wherein the at least two rails increase a fin area of the watercraft by at least one hundred percent.

19. The stability device of claim 16, wherein the at least two rails increase the fin area of the watercraft by at least one-hundred fifty percent.

* * * * *